US006145700A

United States Patent [19]

Takahashi et al.

[11] Patent Number: 6,145,700

[45] Date of Patent: Nov. 14, 2000

[54] DRUG DISPENSING APPARATUS

[75] Inventors: Hideyuki Takahashi; Manabu Haraguchi, both of Gunma-ken, Japan

[73] Assignee: Sanyo Electric Co., Ltd., Osaka, Japan

[21] Appl. No.: 09/277,245

[22] Filed: Mar. 26, 1999

[30] Foreign Application Priority Data

| | | | |
|---|---|---|---|
| Mar. 26, 1998 | [JP] | Japan | 10-100421 |
| Mar. 26, 1998 | [JP] | Japan | 10-100422 |
| Jul. 23, 1998 | [JP] | Japan | 10-207961 |

[51] Int. Cl.[7] ..... B65H 1/00

[52] U.S. Cl. ..... 221/133; 221/289

[58] Field of Search ..... 221/131, 133, 221/123, 289, 129, 2, 7, 13

[56] References Cited

U.S. PATENT DOCUMENTS 5,651,476 7/1997 Percy et al. ..... 221/133

*Primary Examiner*—Kenneth W. Noland
*Attorney, Agent, or Firm*—Darby & Darby

[57] ABSTRACT

The present invention has a purpose to provide a drug dispensing apparatus realizing an effective large-scale operation for a limited installation space. The drug dispensing apparatus, in an outline, has a main body of which top has a constitution of a case containing unit attached to the main body, a plurality of tablet cases attached to the space between the front surface of the case containing unit attached to the main body and the inside of the case containing unit attached to the main body and storing respective drugs, a shoot of the main body, attached to the back of the case containing unit attached to the main body and in which the drug discharged from respective tablet cases drops, a hopper installed in the main body corresponding to the bottom of the shoot of the main body, a door unit closing the front opening of the case containing unit attached to the main body in openable condition, a case containing unit near the door installed in the door unit, a plurality of tablet cases attached to the inside of the case containing unit attached to the door and respectively contains drugs, and a shoot attached to the door, attached to the door unit, in which the drug discharged from respective tablet cases inside the case containing unit drops, and the shoot attached to the door corresponds to the top of the hopper under the condition that the door unit has closed the case containing unit attached to the main body.

13 Claims, 18 Drawing Sheets

DRUG DISPENSING APPARATUS

BACKGROUND OF THE INVENTION (i) Field of the Invention

The present invention relates to a drug dispensing apparatus for dispensing a drug contained in a tablet case as much as a quantity designated by a prescription to a container (a bag or a bottle) in a hospital or the like.

(ii) Description of the Related Art

Heretofore, in a hospital and a pharmacy, for example, as shown in Japanese Utility Model Publication No. 5282/1982 (B65B1/30), a drug dispensing apparatus (which is named a drug packer in the Utility Model Publication) is used to provide a drug prescribed by a doctor to a patient. According to this system, some drugs (inclusive of tablets and capsules) described in a prescription are discharged one by one from a discharging drum (which is named an arranger board in the above-mentioned Utility Model Publication) in the tablet case, and the thus discharged drugs are collected by a hopper and then packed.

In recent years, also in hospitals and pharmacies, the improvement of a work space efficiency is demanded, and it is urgently required to increase the capacity of the drug dispensing apparatus without enlarging the installation space for the drug dispensing apparatus. In consideration of this point, a design has been given so as to make it possible to additionally install an assistant stand in the above-mentioned Utility Model Publication. However, even by such a constitution, the receivable capacity is limited.

SUMMARY OF THE INVENTION

The present invention has been achieved to solve such conventional technical problem, and it provides the drug dispensing apparatus satisfying large quantity handling effective to a limited installation space.

The first aspect of the present invention is directed to a drug dispensing apparatus which comprises a main body having a case housing section of the main body at its top; a plurality of tablet cases, for storing the drugs, which are attached from a front opening of the case housing section of the main body to the inside of the case housing section of the main body; a shoot of the main body which is attached to the back of the case housing section of the main body and through which the drugs discharged from the respective tablet cases drop; a hopper installed in the main body so as to be directed to the bottom of this shoot of the main body; a door unit capable of openably closing the front opening of the case housing section of the main body; a case housing section of the door unit provided on this door unit; a plurality of tablet cases which are attached to this case housing section of the door unit and which receive the drugs respectively; and a shoot of the door unit which is attached to the door unit and through which the drugs discharged from the respective tablet cases in the case housing section of the door unit drop; said shoot of the door unit being directed to the top of the hopper in a condition that the case housing section of the door unit is closed by the door unit.

The second aspect of the present invention is directed to the drug dispensing apparatus which is equipped with an additional unit detachably connected to the back of the main body; said additional unit being provided with an case housing section of the additional unit, a plurality of tablet cases, for storing the drugs respectively, which are attached to this case housing section of the additional unit; and an shoot of the additional unit which is attached to a front side and through which the drugs discharged from the respective tablet cases in the case housing section of the additional unit drop; said shoot of the additional unit being connected to the hopper of the main body in such a condition as to be connected to the back of said main body.

The third aspect of the present invention is directed to the drug dispensing apparatus, wherein openable shutters are attached to the lower ends of the shoot of the main body, the shoot of the door unit and the hopper, or the lower ends of the shoot of the main body, the shoot of the door unit and the shoot of the additional unit and the hopper, respectively.

The fourth aspect of the present invention is directed to the drug dispensing apparatus which is equipped with a rack device which is hung in each case housing section and in which a plurality of tablet cases are arranged side by side; and rack holding sections, for detachably holding the rack device, which are formed in each case housing section; said tablet cases having a plurality of large and small sizes; the plurality of rack holding sections being formed extending over top and bottom of each case housing section.

The fifth aspect of the present invention is directed to a drug dispensing apparatus which comprises a main body having a case housing section of the main body at its top; a plurality of tablet cases, for storing the drugs, which are attached in the case housing section of the main body; a shoot of the main body which is attached in the case housing section of the main body and through which the drugs discharged from the respective tablet cases drop; a hopper installed in the main body so as to be directed to the bottom of this shoot of the main body; a plurality of door units capable of openably closing the front opening of the case housing section of the main body; a case housing section of the door unit provided on each door unit; a plurality of tablet cases which are attached to this case housing section of the door unit and which receive the drugs respectively; and a shoot of the door unit which is attached to each door unit and through which the drugs discharged from the respective tablet cases in the case housing section of the door unit drop; each of said door units being attached movably in a transverse direction on the front side of the case housing section of the main body so that the case housing section of the main body may be opened and closed; the shoot of the door unit of each door unit being connected to the hopper irrespective of any position of the case housing section of the main body.

The sixth aspect of the present invention is directed to the drug dispensing apparatus, wherein a connecting portion with the hopper is formed over a moving range of a lower end opening of the shoot of the door unit, and a means for closing the connection portion except portions where the lower end opening is present.

The seventh aspect of the present invention is directed to the drug dispensing apparatus which is equipped with an additional unit detachably connected to the back of the main body; said additional unit being provided with an case housing section of the additional unit, a plurality of tablet cases, for storing the drugs respectively, which are attached to this case housing section of the additional unit; and an shoot of the additional unit which is attached to a front side and through which the drugs discharged from the respective tablet cases in the case housing sect ion of the additional unit drop; said shoot of the additional unit being connected to the hopper of the main body in such a condition as to be connected to the back of said main body.

The eighth aspect of the present invention is directed to the drug dispensing apparatus, wherein openable shutters are attached to the lower ends of the shoot of the main body, the shoot of the door unit and the hopper, or the lower ends of the shoot of the main body, the shoot of the door unit and the shoot of the additional unit and the hopper, respectively.

The ninth aspect of the present invention is directed to the drug dispensing apparatus which is equipped with a rack device which is hung in each case housing section and in which a plurality of tablet cases are arranged side by side; and rack holding sections, for detachably holding the rack device, which are formed in each case housing section; said tablet cases having a plurality of large and small sizes; the plurality of rack holding sections being formed extending over top and bottom of each case housing section.

DETAILED DESCRIPTION OF THE PREFERRED EMBODIMENT

Figure 1:
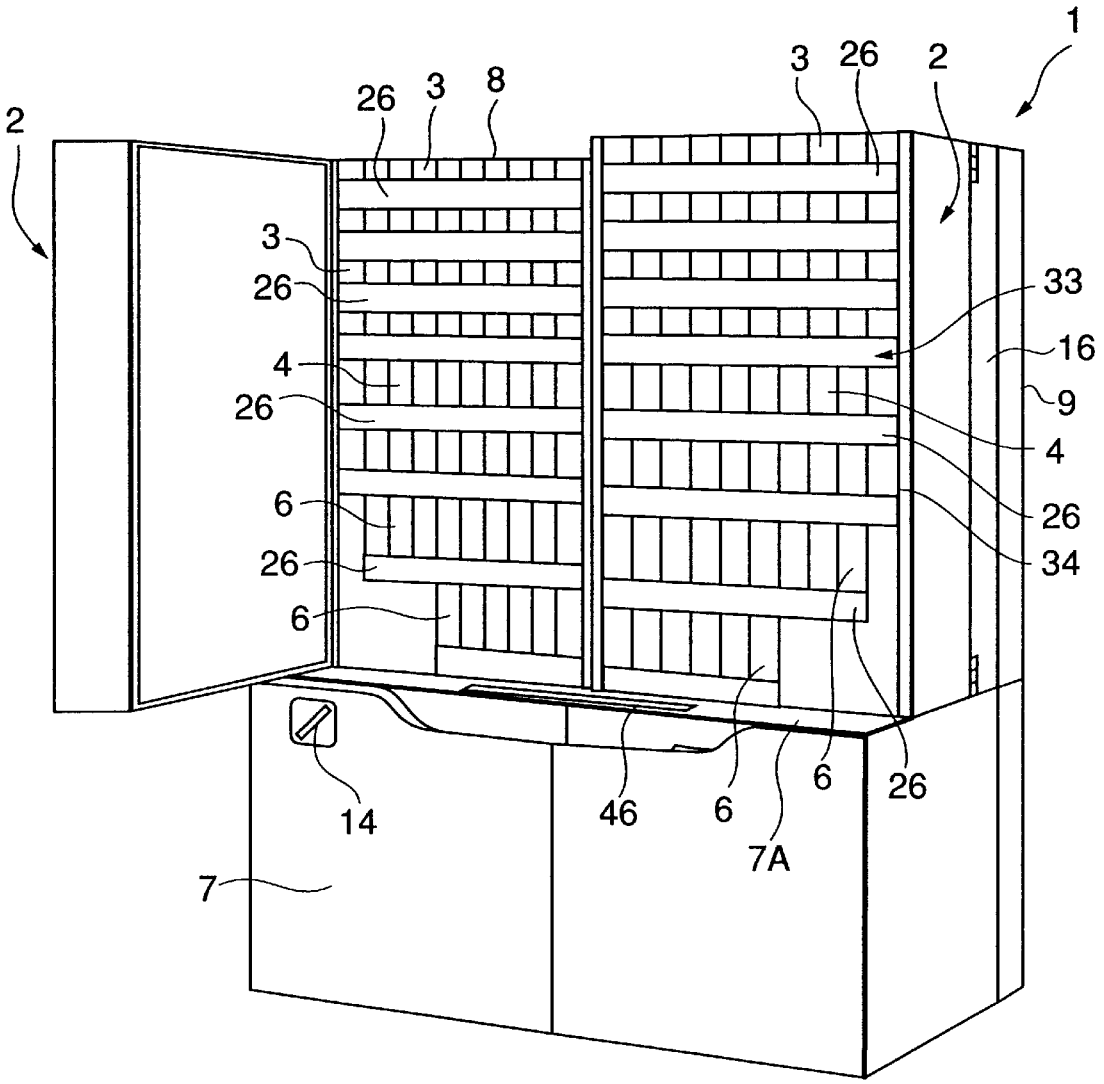
FIG. 1 is a perspective side view of the drug dispensing apparatus of the present invention with the one door unit opened.
Figure 3:
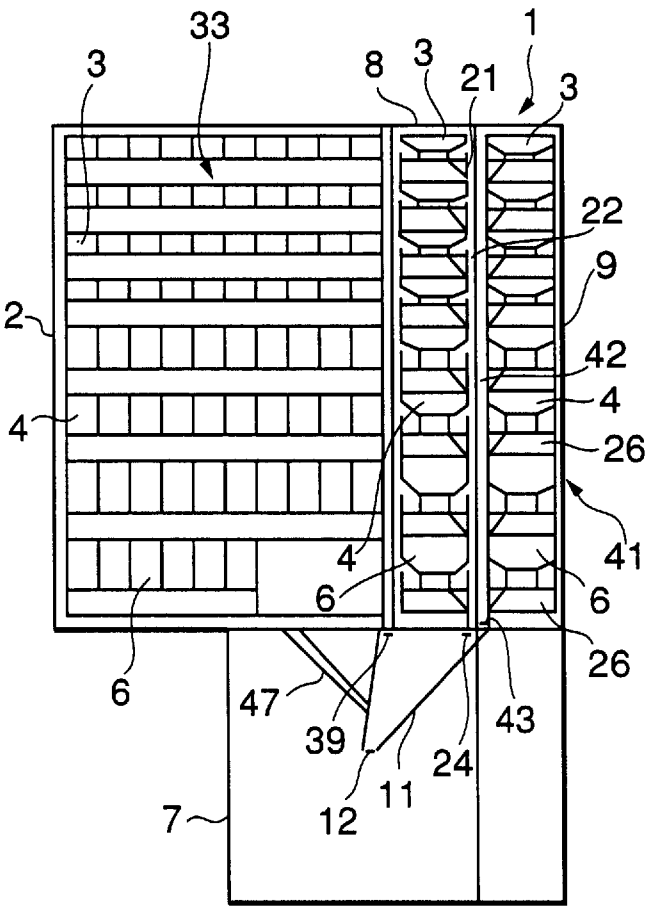
FIG. 3 is a partially perspective side view of the same drug dispensing apparatus.
Figure 2:
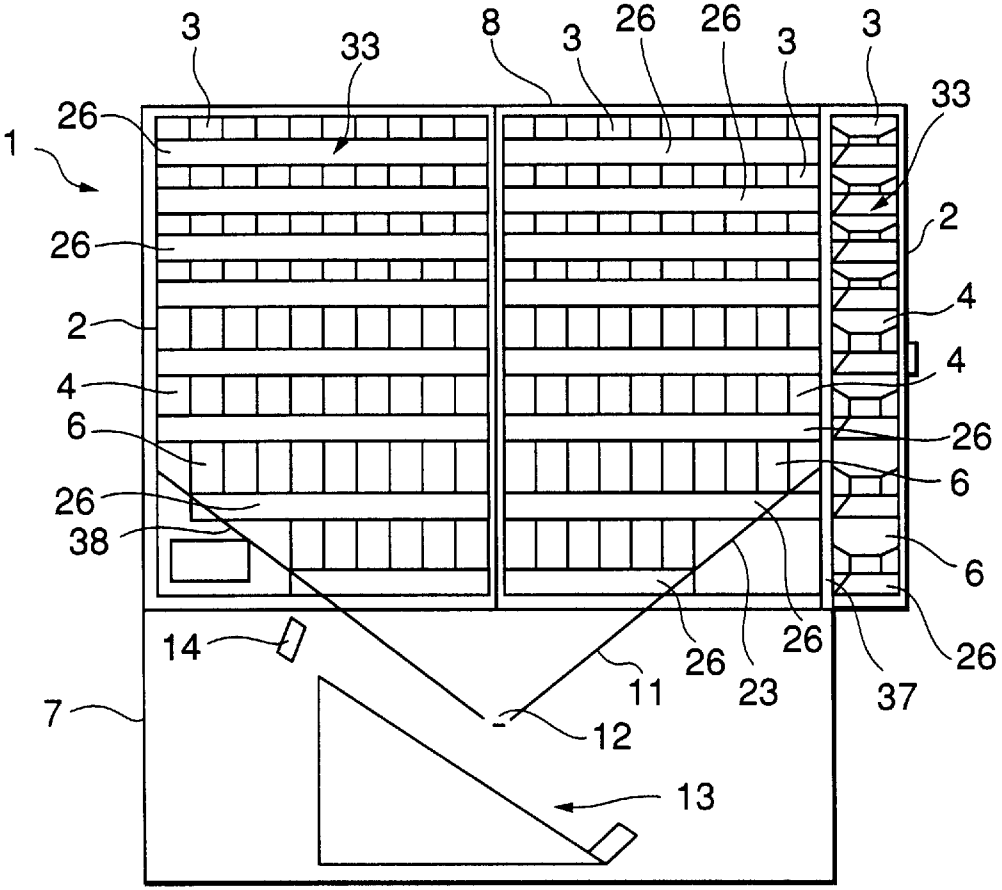
FIG. 2 is a partially perspective frontal view of the drug dispensing apparatus of the present invention with the other door unit opened.
Figure 4:
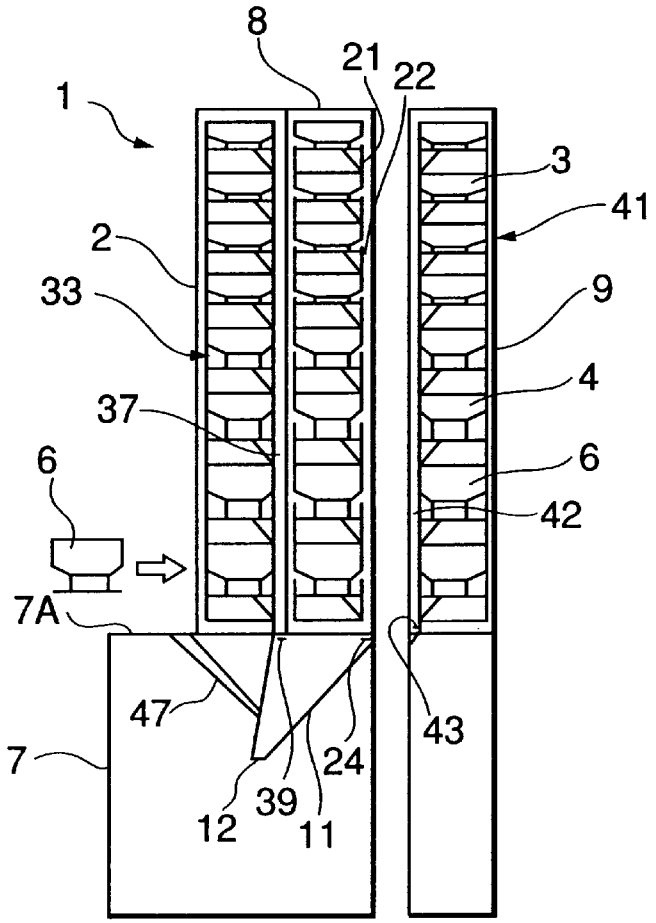
FIG. 4 is a partially perspective side view of the drug dispensing apparatus of the present invention with both the door units closed.
Figure 5:
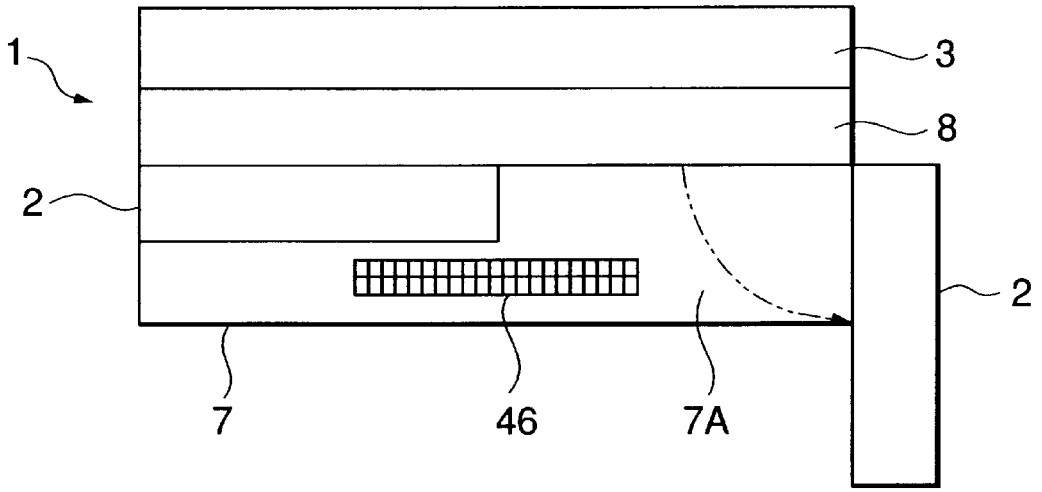
FIG. 5 is a plan view of the drug dispensing apparatus of the present invention with the other door unit opened.

An example of the present invention is given below in detail with reference to FIGS. 1 to 12. The drug dispensing apparatus 1 of the present invention is installed in hospitals and pharmacies and comprises the main body 7 with transversely long rectangular shape, the case containing unit 8, that is installed in the back of the top surface 7A of the main body 7, in the main body, door units 2 and 2, with double doors opening outward, closing to be openable the front opening of the case containing unit 8 of the main body, an additional unit 9 being attachable and detachable in the back of said main body 7 and attached optionally according to situation, etc.

The top of the inside of said main body 7 has a hopper 11 to open upward and the bottom end of the hopper 11 has a shutter 12. On the other hand, a packer 13 is installed inside the main body 7 located downward of the hopper 11 and a drug discharged from the hopper 11 is packed with a roll-like wrapping paper, not illustrated, obliquely installed to discharge from an outlet opening 14 to send out.

Figure 9:
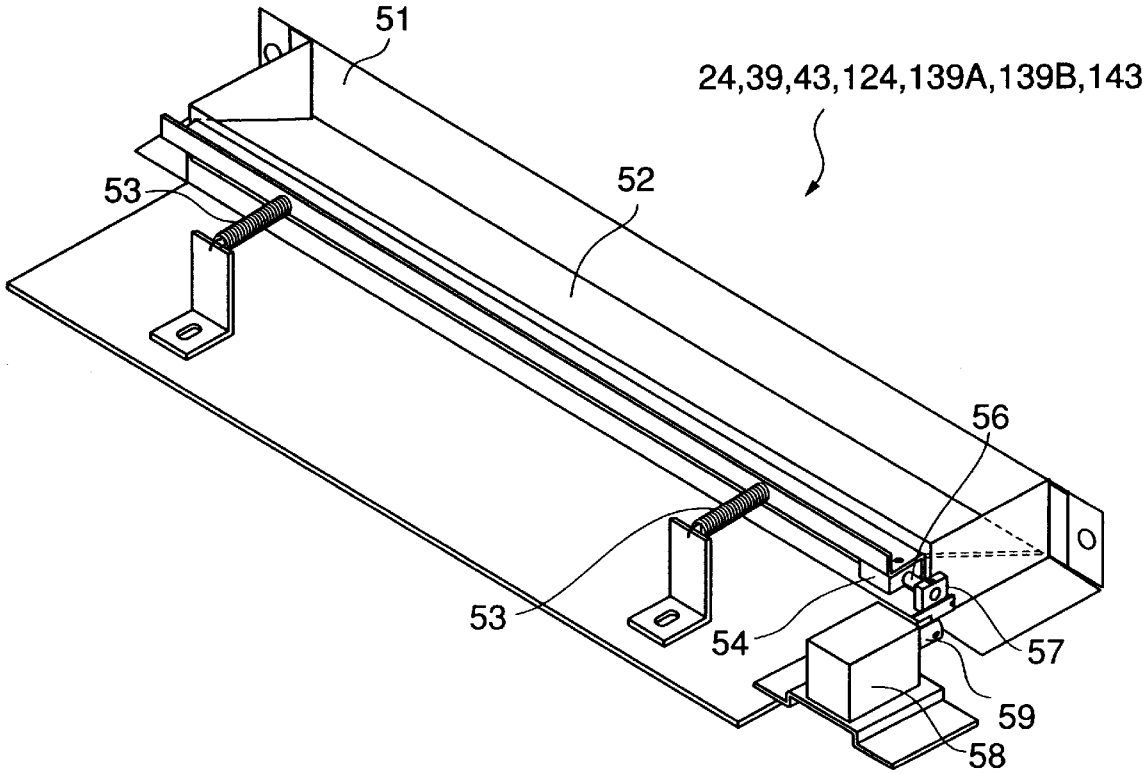
FIG. 9 is a perspective side view of a shutter of the drug dispensing apparatus of the present invention.

On the other hand, said case containing unit 8 of the main body has a front opening and at least left and right sides thereof are closed with a clear wall 16 made of glass or a resin. These clear walls 16 and 16 have a plurality of rack holding sections 17 in a given interval between top and bottom. Respective rack holding sections 17, as shown in FIG. 9, comprises a pair of electroconductive, front and back projections 18 and 18.

In the back of the case containing unit 8 of the main body, the shoot 22 attached to the main body is divided into the upper and lower parts ranging full width by using a partitioning board. The bottom of both sides of the shoot 22 attached to the main body have bottom surfaces 23 and 23 formed tilting between left and right ends of the case containing unit 8 of the main body and both sides of the upper edge of said hopper 11. And, the space between bottom surfaces 23 and 23 open corresponding to the top of the hopper 11. A shutter 24 is attached to the top surface 7A of the main body 7 in the position corresponding to the opening. The structure of the shutter 24 will be mentioned later in detail.

The rack device 26 is installed in said rack holding sections 17. A plurality of tablet cases 3 (or, 4 or 6) is attached to the rack device 26. A plurality of groovy attachment units 27 for cases are formed on left and right sides of said rack device 26 in a given interval. Discharging passage 28 is respectively formed inside the rack device 26 corresponding to respective attachment units 27 for cases. Respective discharging passages 28 have counters not illustrated.

Figure 8:
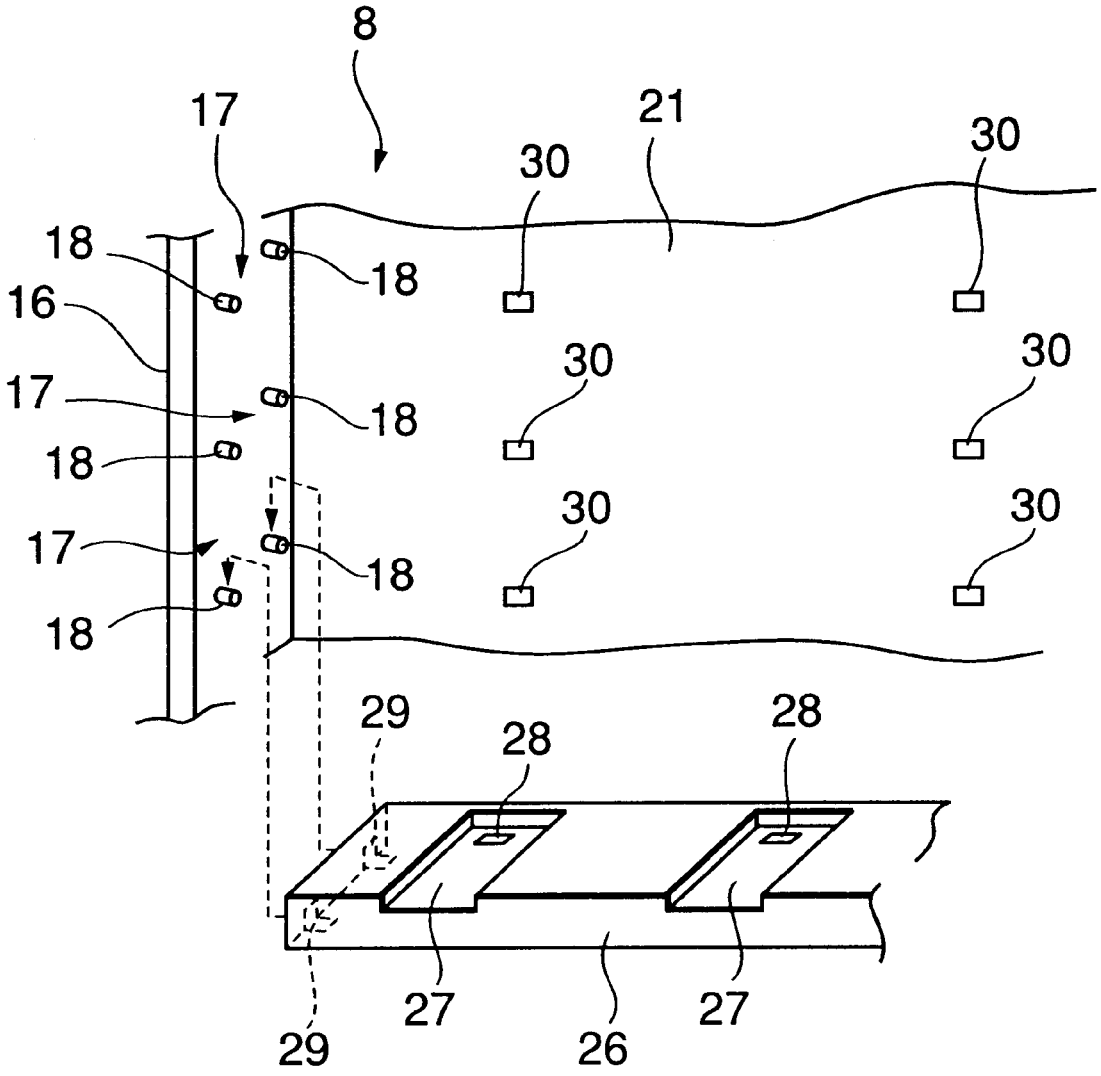
FIG. 8 is a perspective side view of a case containing unit of the main body of the drug dispensing apparatus of the present invention.

Engaging grooves 29 and 29 are formed in the front and back of both ends of the rack device 26 as showed with a broken line in FIG. 8. The engaging grooves 29 and 29 are engaged with said projections 18 and 18 attachably and detachably from the top and by this structure, the rack device 26 are attachably and detachably installed in the rack holding sections 17 and the electric circuit inside the rack device 26 is electrically wired to these projections 18 and 18.

Besides, said partitioning board 21 has a plurality of through holes 30. Said through holes 30 . . . correspond respectively to the opening of the back surface of respective discharging passages 28 . . . under the condition of that the rack device 26 has been installed. For reference, rack device 26 in the lower steps is constituted having a narrow transverse width according to tilt of said bottom surface 23.

Figure 6:
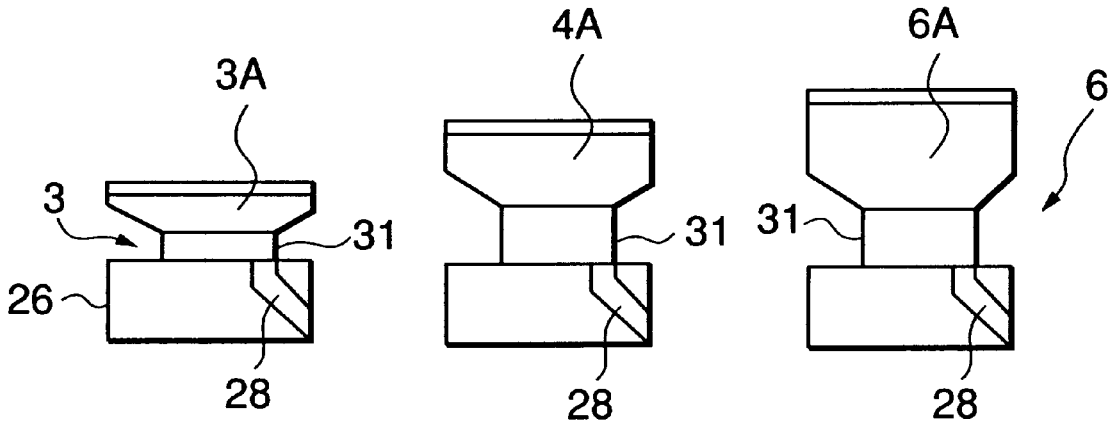
FIG. 6 is a side view of the tablet case of the drug dispensing apparatus of the present invention.
Figure 7:
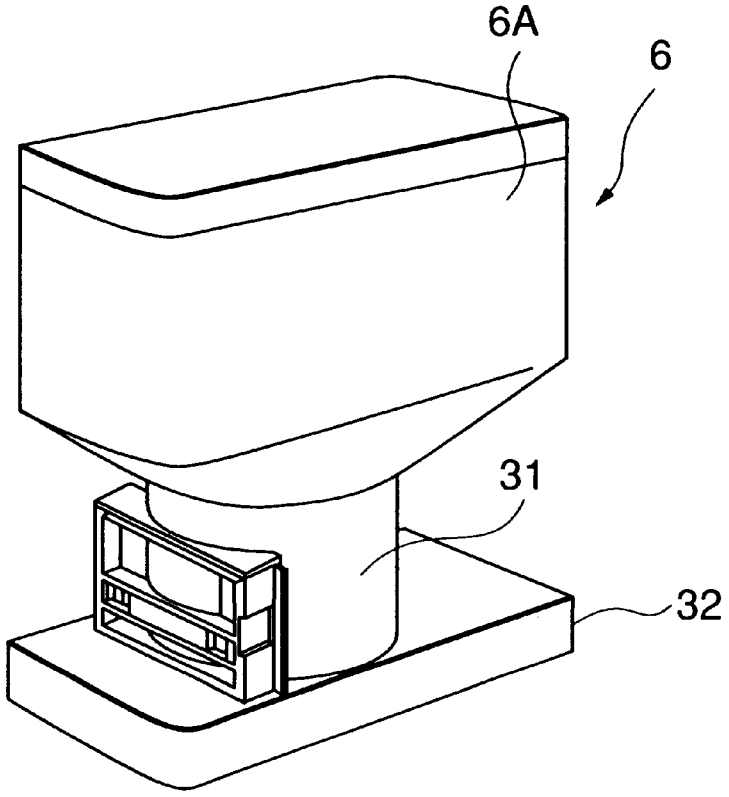
FIG. 7 is a perspective side view of the tablet case of the drug dispensing apparatus of the present invention.

As shown in FIG. 6 and FIG. 7, said tablet cases 3, 4, and 6 comprise clear containers 3A, 4A, and 6A, a discharging mechanism 31 installed in the bottom end thereof, and a base 32 installed in the bottom end of the discharging mechanism 31. The discharging mechanism 31 and the base 32 are common and only one difference is between sizes of heights of respective containers 3A, 4A, and 6A. Thus, the volume of respective tablet cases 3, 4, and 6 is, for example, 250 ml, 500 ml, and 800 ml, respectively. For reference, the structure of said discharging mechanism 31 comprising a drum to discharge each one of drugs and a motor to rotate this drum (either not illustrated) is publicly known.

These tablet cases 3, 4, and 6 are adjacently installed on said rack device 26. In this case, the bases 32 of these tablet cases 3, 4, and 6 are engaged with said engaging grooves 29 attachably and detachably from the front. In this status, the discharging unit of said discharging mechanism 31 corresponds to the opening of the top surface of said discharging passages 28 and simultaneously, the motor of the drum of the discharging mechanism 31 is wired to an electric circuit inside the rack device 26.

On the other hand, the case containing unit 33 near the door is respectively installed in said door units 2 and 2. Respective the case containing units 33 and 33 near the door have openings in their front and the front openings are closed in openable manner by a clear door 34. And, left-hand and right-hand sides are covered with a steel board, for example. These left-hand and right-hand sides have a plurality of the rack holding sections 17 with the same structure stated before in top and bottom in a given interval.

In the back of the case containing unit 33 and 33 near the door, the shoot 37 near the door is divided into top and bottom parts ranging the full width of respective door units 2 and 2 by using the frontal partitioning board 36. The lower part of the shoot 37 and 37 near the door have tilted bottom surfaces 38 and 38 respectively formed between outer ends of the case containing unit 33 and 33 near respective doors and both sides of the upper edge of said hopper 11. And, an opening is formed between both bottom surfaces 38 and 38 corresponding to the top of the hopper 11 in closed status of the front opening of the case containing unit 8 near the main body. A shutter 39 with the same structure stated before is attached to the top surface 7A in the position corresponding to the opening.

The rack device 26 (be a half size width in this case) with the same structure is also installed in the rack holding sections 17 of respective case containing units 33 and 33 near doors. The rack device 26 also has a plurality of the same tablet cases 3 (or, 4 or 6). The discharging passage 28 of the rack device 26 of the case containing units 33 near doors has been connected to the shoot 37 near the door.

In the status of closed door units 2 and 2, the top surface 7A of the main body 7 positioned in front thereof have an additional drug feeder 46 to supply optionally an additional drug. A passage 47 extends from the feeder 46 to the hopper 11.

Said application unit 9 is a unit installed on the back of the main body 2 according to an increasing scale of a hospital, for example, in order to install additionally tablet cases 3 (4 or 6), and the top thereof has the case containing unit 41 of the additional unit (the case containing unit of the additional unit). Left and right sides of the additional unit 41 are closed with a clear wall made of glass or a resin. These left and right clear walls have a plurality of rack holding sections 17 same as that stated before in a given interval from top to bottom.

The shoot of the additional unit in front of the case containing unit of the additional unit 41 is divided into top and bottom parts ranging a full width. The both lower parts of the shoot 42 of the additional unit have a tilted bottom surface formed between the left and right ends of the case containing unit 41 of the additional unit and both sides of the upper edge of said hopper 11. And, the opening between both bottom surfaces corresponds to the through hole formed in the back surface of the main body 2 positioned in the back of the top end of the hopper 11 in installed status of the additional unit 9 in the main body 2. According to this structure, the shoot 42 of the additional unit is connected to the hopper 11, and a shutter 43 with the same structure stated before is attached to said opening.

And, the rack holding section 17 of the case containing units 41 of the additional unit has same rack device 26, and the rack device 26 also has a plurality of tablet cases 3 (or, 4 or 6) in the same manner. The discharging passage 28 of the rack device 26 of the case containing units 33 in the additional unit has been connected to the shoot 42 in the additional unit. In addition, The additional unit 9 is electrically wired in installed status in the main body 2.

Figure 10:
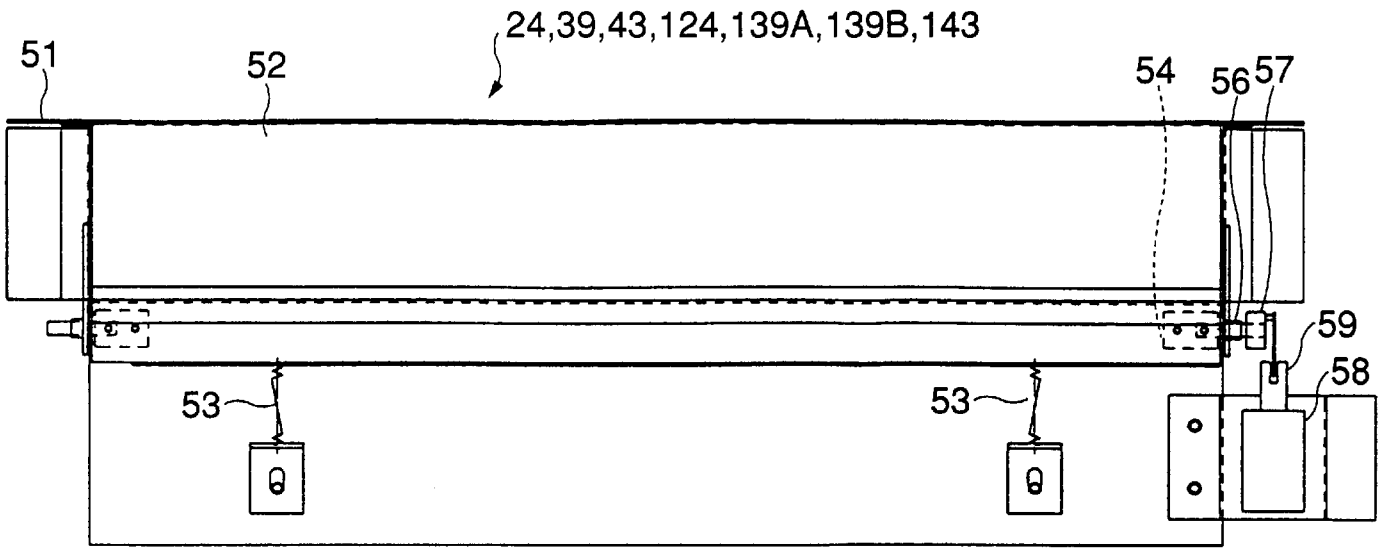
FIG. 10 is a plan view of a shutter of the drug dispensing apparatus of the present invention.
Figure 11:
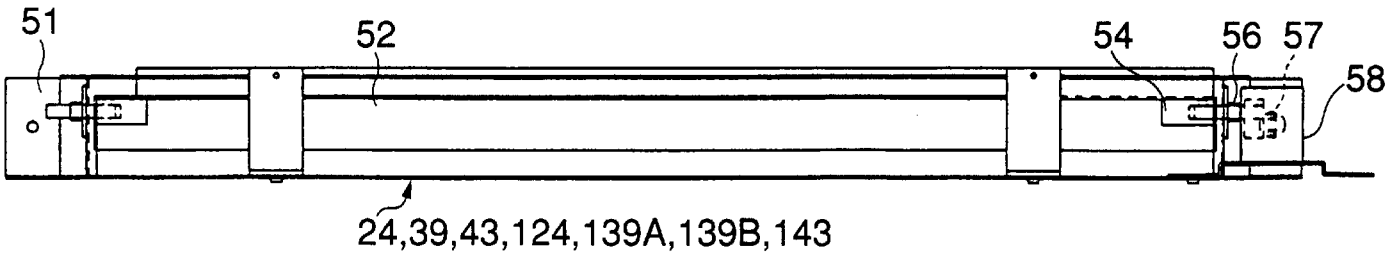
FIG. 11 is a frontal view of a shutter of the drug dispensing apparatus of the present invention.
Figure 12:
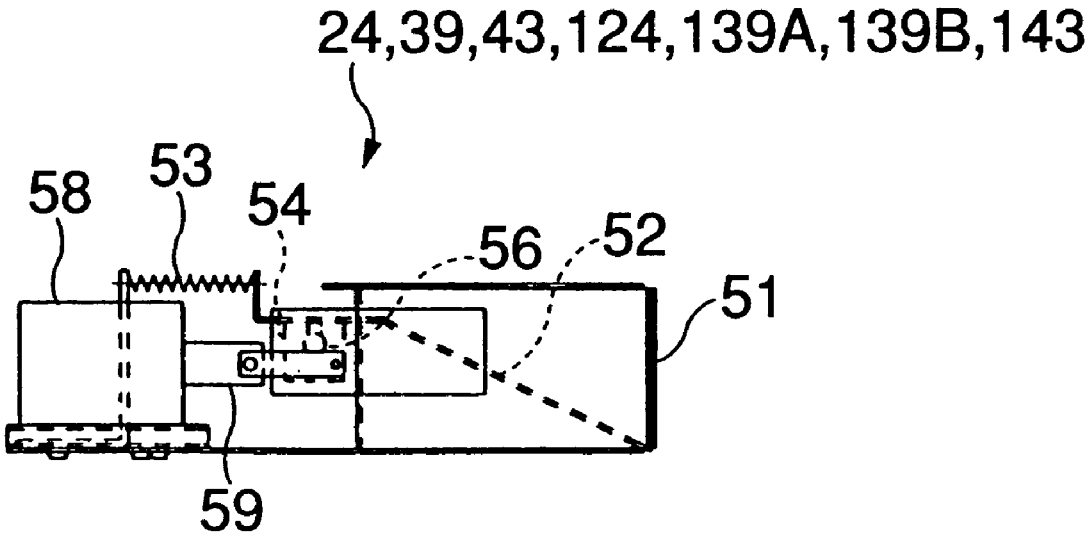
FIG. 12 is a side view of a shutter of the drug dispensing apparatus of the present invention.

Herewith, the structure of said respective shutters 24, 39, and 43 will be described with reference to FIG. 9–FIG. 11. Any one of respective shutters 24, 39, and 43 has same structure and comprises a shutter board 52 of which one side has been supported by a frame body 51 to allow free rotation in order to open and close the passage, a spring 53 energizing this shutter board 52 to close always, and a solenoid 58 making said shutter board 52 a rotative motion through an attachment 54, a shaft 56, and a connector 57.

Electrification of the solenoid 58 sucks a plunger 59 connected to the connector 57 allowing free rotative motion, and opens the shutter board 52 against energized force of the spring 53. The solenoid 58 not electrified close the shutter board 52 by the spring 53 and the plunger 59 projects from the solenoid 58.

The use and action of the drug dispensing apparatus 1 of the present invention is described below based on these constitutions. It is assumed that said respective shutters 12, 24, 39, and 43 have been closed in the condition of power source turned on. When the case containing unit 8 near the main body, case containing units 33 and 33 near doors of respective door units 2 and 2, and the additional unit 9 are installed, said tablet cases 3, 4, or 6 is installed, in which a given drug has been respectively contained, in the case containing units 41 of the additional unit. In this case, a drug of a large dosage quantity or a drug with a large size is contained in a tablet case 6 for a large volume, a drug of a medium dosage quantity or a drug with a medium size is contained in a tablet case 4 for a medium volume, a drug of a smallest dosage quantity or a drug with a smallest size is contained in a tablet case 3 for a small volume. The tablet cases 3, 4, or 6 are adjacently installed on the rack device 26 as mentioned before. In this arrangement, tablet cases with same volume are installed on the same the rack device 26.

Subsequently, the rack device 26 is installed on the rack holding section 17 of respective case containing units as stated before. As mentioned before, a plurality of the rack holding section 17 has been installed in a given interval from top to bottom and the interval between the top to bottom rack devices 26 is determined according to sizes from top to bottom of the tablet case. This means that the distance between the rack devices 26 in which a tablet case 6 of a large volume and the rack devices 26 thereupon is expanded to a distance corresponding to from top to bottom of the sizes of the tablet case 6 by removing some rack holding section 17. On the contrary, the distance between the rack devices 26 in which a tablet case 3 of a small volume and the rack devices 26 thereupon is reduced to correspond to the sizes from top to bottom of the tablet case 3 by installing on the upward and downward adjacent rack holding sections 17 and 17.

In the example, four steps from the top are used for tablet case 3 of a small volume, two steps just thereunder are used for the tablet case 4 for a medium volume, and the lowest two steps are used for tablet case 6 for a large volume. Application to drugs of small size and large volume can be achieved by using effectively the inside of respective case containing unit 8, 21, and 41, because the tablet cases 3, 4, or 6 can be used according to various sizes and various quantities of drugs and interval between the rack devices 26 and 26 can be freely designated according to the size of the tablet case.

Subsequently, a discharging mechanism 31 of the tablet case 3 (4, or 6), in which a drug designated based on the prescription data has been installed, is actuated by a control apparatus, not illustrated, of the drug dispensing apparatus 1 to discharge the drug to the discharging passage 28, immediately after an operator inputs a formula data from an inputting apparatus (a personal computer), not illustrated, according to the prescription of a doctor. The drug discharged to the discharging passage 28 is counted and simultaneously, a given quantity enters respective shoots 22, 37, and 42 to collect on the bottom shutters 24, 39, and 43.

Then, after the shutters 24, 39, and 43 are opened, the drug drops in the hopper 11 to be collected on the shutter 12. The shutter 12 has been made as has structure allowing insertion inside a packing bag. After this step, the shutter 12 is opened to drop the drug on the wrapping paper and pack by a packing machine 1, and finally it is sent out from an outlet mouth 14. At this time, when the drug to wrap is present in respective case containing units 8, 33, 33, and 41 the drug is simultaneously discharged from the tablet cases 3 (4, or, 6) in respective case containing units 8, 33, 33, and 41 and simultaneously, or after opening the shutter of the containing unit of the tablet cases from which the drug was discharged to wrap. According to this step, a time necessary for wrapping can be shorten.

As known from these descriptions of the present invention, the drug dispensing apparatus has a main body of which top has a constitution of a case containing unit attached to the main body, a plurality of tablet cases attached to the space between the front surface of the case containing unit attached to the main body and the inside of the case containing unit attached to the main body and containing respective drugs, a shoot of the main body, attached to the back of the case containing unit attached to the main body, in which the drug discharged from respective tablet cases drops, a hopper installed in the main body corresponding to the bottom of the shoot of the main body,, a door unit closing the front opening of the case containing unit attached to the main body in openable condition, a case containing unit installed in the door unit, a plurality of tablet cases attached to the inside of the case containing unit attached to the door and respectively containing drugs, and a shoot attached to the door, attached to the door unit, in which the drug discharged from respective tablet cases inside the case containing unit drops, and the shoot attached to the door corresponds to the top of the hopper under the condition that the door unit has closed the case containing unit attached to the main body. Thus, a volume for containing drugs can be considerably increased in comparison with the installation space of whole apparatus.

In addition to this advantage, an additional unit connected to the back of the main body attachably and detachably is installed in aforementioned constitution. The additional unit is attached to the case containing unit for the additional unit and the inside of the case containing unit for the additional unit, has a plurality of tablet cases containing drugs respectively and a shoot, installed in the front, in the additional unit, in which the drug discharged from respective tablet cases inside the case containing unit in the additional unit drops, and the shoot in the additional unit under a connected condition to the back of the main body is connected to the hopper of the main body. Thus, when an additional unit is installed according to increased works, a large-scale operation can be very easily accomplished.

Further, in addition to these respective inventions, the drug dispensing apparatus of the present invention has respective openable shutters in the bottom end of a shoot attached to the main body, a shoot attached to a door, and a hopper, or the bottom end of the shoot attached to the main body, the shoot of the door, the shoot attached to the additional unit, and the hopper. Thus, fast supply of drugs from many tablet cases installed can be achieved by holding drugs, that are discharged from tablet cases in respective case containing units to each shoot corresponding thereto, to discharge by respective shutters controlling timing.

Furthermore, the drug dispensing apparatus of the present invention in addition to said respective inventions has a rack device installed in respective case containing units and has a plurality of tablet cases adjacently arranged and a rack holding section installed in respective case containing units and holding the rack device attachably and detachably, and tablet cases have a plurality of top and bottom sizes and also a plurality of the rack holding sections are made from top to bottom of respective case containing units. Thus, The volume of a tablet case can be selected according to the size and quantity of a drug and also, an interval between respective rack devices can be freely designated according to the size of the tablet case.

According to this, the inside of case containing unit can be effectively used, and a small size of the drug dispensing apparatus and a large scale performance can be very easily accomplished.

Next, another example of the present invention is given below with reference to FIG. 13–FIG. 23 in detail. The drug dispensing apparatus 101 of the present invention is installed in hospitals and pharmacies and comprises the main body 107 with transversely long rectangular shape, an outer case 107A, with a rectangular shape, installed on the main body 107 and an opening in the front surface, the case containing unit 108, that is installed in the back inside the outer case 107A, in the main body, sliding door units 102A and 102B installed in the front outer case 107A of the case containing unit 108 in the main body, arranged front and back, and installed in the top surface of the main body 107 transversely movably, an additional unit 109, etc. being attachable and detachable in the back of said main body 107 and attached optionally according to situation.

The top of the inside of the main body 107, located in the position lower than that of said outer case 107A, has a hopper 111 to open upward and the bottom end of the hopper 111 has a shutter 112. On the other hand, a printer 110 and a sealer 113 composing a packer is installed inside the main body 107 located downward the hopper 111 and a drug discharged from the hopper 111 is wrapped with a roll-like wrapping paper 115 (refer to FIG. 17) obliquely installed to discharge from an outlet opening 114.

Figure 14:
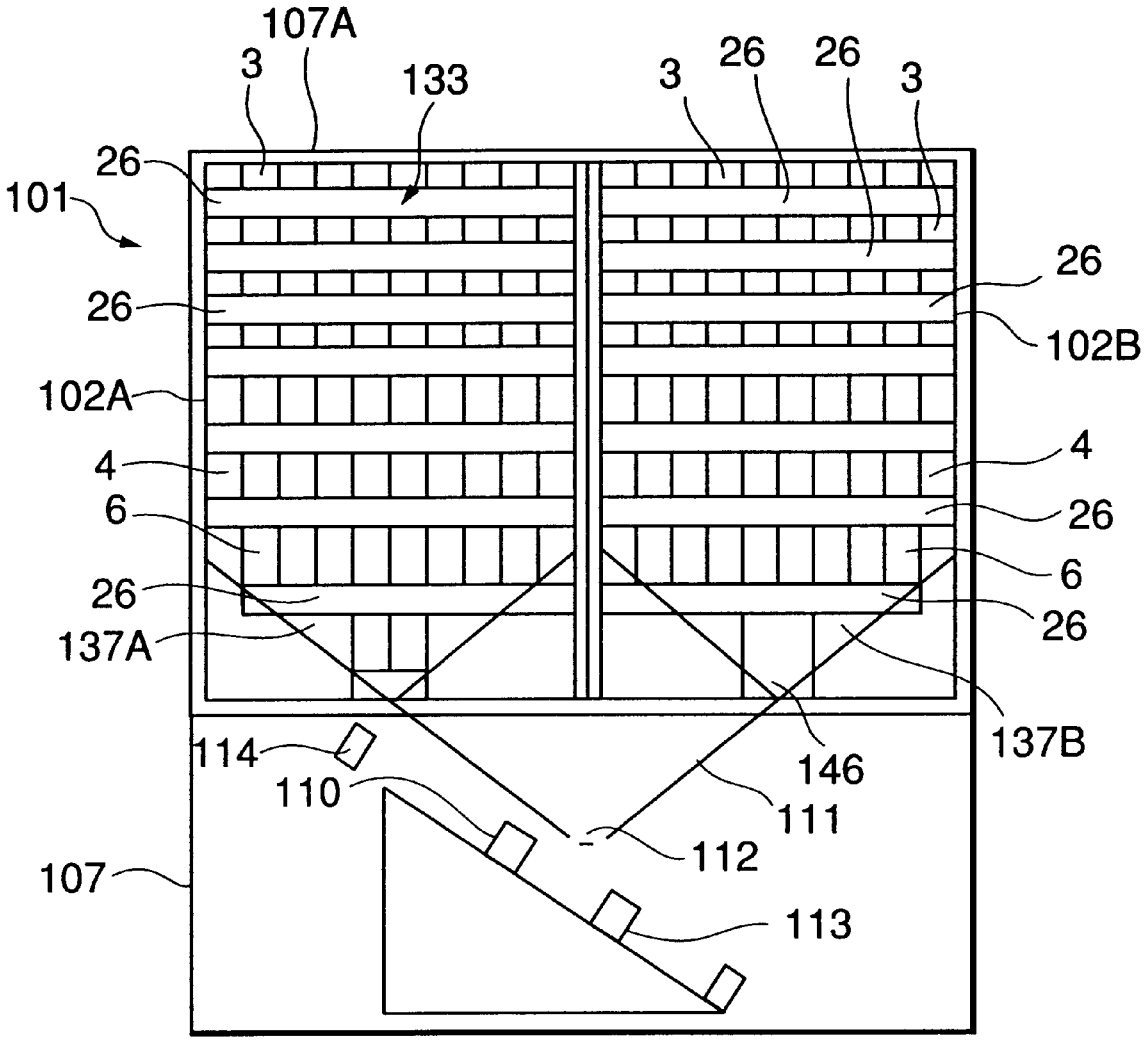
FIG. 14 is a partially perspective frontal view of the drug dispensing apparatus of FIG. 13.
Figure 16:
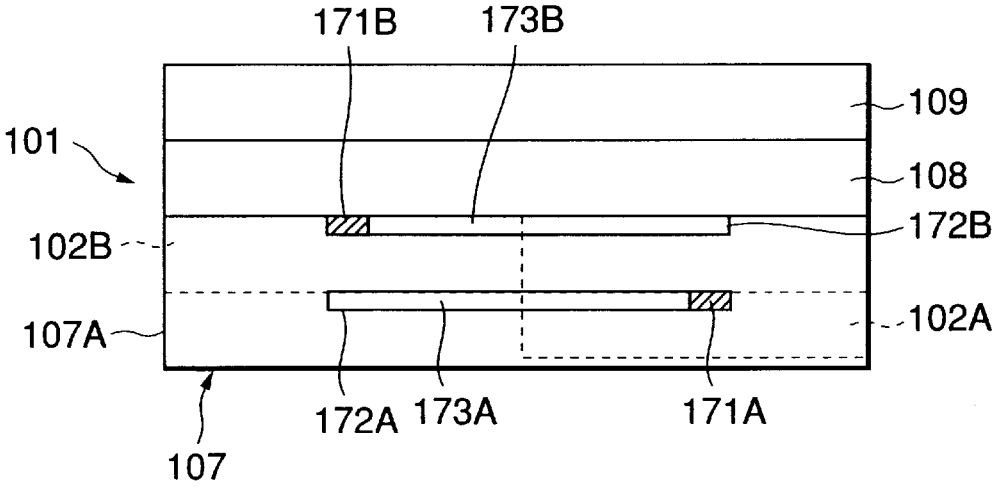
FIG. 16 is a partially perspective plan view of the drug dispensing apparatus of FIG. 13.

On the other hand, said case containing unit 108 installed in the main body opens in front surface; the opening is opened and closed by said door units 102A and 102B. Said door units 102A and 102B are installed in about a half width of the case containing unit 108 installed in the main body and usually as shown in FIG. 14, the front door units 102A and the back door units 102B are positioned in left-hand side and right-hand side, respectively. Independent moving of them allows reverse arrangement in right- and left-hand sides as shown in FIG. 16. And, a part of the front surface of the case containing 108 installed in the main body is released in the condition of that both door units 102A and 102B contact each other. Changing the positions of both units 102A and 102B allows selecting the opening portion of the case containing 108 installed in the main body.

Besides, in the back of the case containing unit 108 of the main body, the shoot 122 in the main body is partitioned ranging from top to bottom by using a partitioning board 121. The bottom of both sides of the shoot 122 attached to the main body has tilted between the left and right ends of the case containing unit 108 of the main body and both sides of the upper edge of said hopper 111.

And, the shoot 122 in the main body opens corresponding to the top of the hopper 111. A shutter 124 same as one shown in FIG. 9–FIG. 12 is attached to the inside of the shoot 122 in the main body. The accurate position of the shutter 124 will be mentioned later in detail.

The rack devices 26 are installed in the case containing unit 108 of the main body and a plurality of tablet cases 3 (or, 4 or 6) same as that shown in FIG. 6 and FIG. 7 is installed in the rack devices 26. A plurality of groovy case attachment units 27 same as that shown in FIG. 8 are formed on left and right sides of said rack device 26 in a given interval. Discharging passage 28 is respectively formed inside the rack device 26 corresponding to respective case attachment units 27 for cases, as shown in FIG. 6. Respective discharging passages 28 have drug detectors 130 mentioned later.

The case containing unit 108 of the main body in this case also has same structure as that of the FIG. 8.

The tablet cases 3, 4, and 6 are adjacently installed each other on said rack device 26, the base 32 of the tablet cases 3, 4, and 6 are engaged with the groove of said case attachment units 27 attachably and detachably from the front, and in this condition, the discharging unit of said discharging mechanism 31 corresponds to the opening of the top surface of said discharging passages 28.

On the other hand, the case containing units 133A and 133B near the door are respectively formed inside said door units 102A and 102B. Respective case containing units 133A and 133B near the door have openings in front and the front openings are closed with the clear door, not illustrated, in an openable manner. Besides, in the back of respective case containing units 133A and 133B near the door, the shoot 37 near the door is partitioned ranging from top to bottom of respective door units 102A and 102B by using a partitioning board 136. The bottom of respective shoots 137A and 137B near the door tilts between the outer end of the case containing unit 133A and 133B near the door and the upper edge of said hopper 111, and the bottom end thereof is opened in openings 171A and 171B of the bottom ends.

On the top surface of the main body 107, connecting units 172A and 172B are formed between left and right moving ranges of these openings 171A and 171B. These connecting units 172A and 172B are opened upward the hopper 111. By this, the openings 171A and 171B of the bottom ends of the shoots 137A and 137B near the door are connected to the upper part of the hopper 111 in all position ranging from left to right movements of respective door units 102A and 102B in front of the case containing unit 108 of the main body, and in respective shoots 137A and 137B near the door, shutters 139A and 139B same as those mentioned before have been installed. The accurate positions of respective shutters 139A and 139B will be described later.

Further, respective connecting units 172A and 172B have lid members 173A and 173B to close the connecting units 172A and 172B other than parts in which the openings 171A and 171B of the bottom ends present. The structure of the lid members 173A and 173B may be a lid board to move left-hand and right-hand according to the movement of the openings 171A and 171B of the bottom ends and a structure comprises a plurality of lid boards to release only the position of the openings 171A and 171B of the bottom ends.

A rack device 26 with same structure (be a half size width in this case) is installed in the case containing unit 133A and 133B near the door, and a plurality of same tablet cases 3 (or, 4 or 6) are installed in the rack device 26. A discharging passage 28 of the rack device 26 of the case containing unit 133A and 133B near the door is connected to the shoots 137A and 137B near the door.

An additional drug feeder 146 is installed in the bottom of the door unit 102B to supply optionally an additional drug, and the feeder 146 is connected to the inside of the shoot 137B near the door in the bottom side of the shutter 139B.

Figure 15:
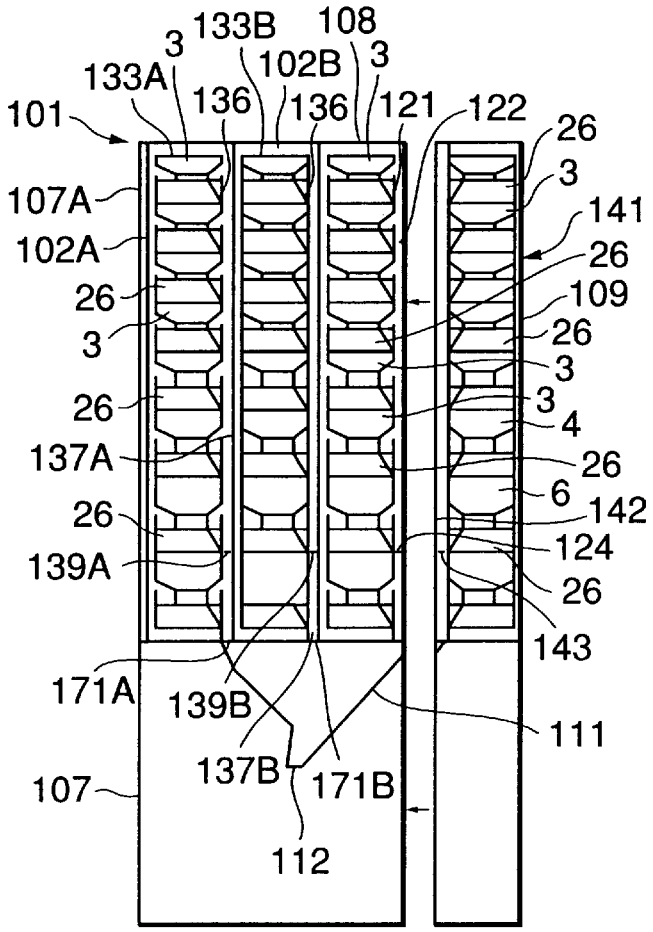
FIG. 15 is a partially perspective side view of the drug dispensing apparatus of FIG. 13.

Said additional unit 109 is a unit installed in the back of the main body 102 as shown by the arrow in FIG. 15 according to an increasing scale of a hospital, for example, in order to install additional tablet cases 3 (4 or 6), and the top thereof has the case containing unit 141 of the additional unit. The shoot 142 of the additional unit has been partitioned in the range from top to bottom of the front of the case containing unit 141 of the additional unit. The bottom of both sides of the shoot 142 near the additional unit has formed tilting between the left and right ends of the case containing unit 141 of the additional unit and both sides of the upper edge of said hopper 111. And, the opening of the bottom end of the shoot 142 near the additional unit corresponds to the through hole formed on the back surface of the main body 102 positioned in the back of the top end of the hopper 111 in installed status of the additional unit 109 in the main body 102. According to this structure, the shoot 142 of the additional unit is connected to the hopper 111, and a shutter 143 with the same structure stated before is attached to the inside of the shoot 142 of the additional unit. The accurate position of the shutter 143 will be described later in detail.

And, the inside of the case containing units 141 of the additional unit has same rack device 26, and the rack device 26 also has a plurality of tablet cases 3 (or, 4 or 6) in the same manner. The discharging passage 28 of the rack device 26 of the case containing units 133 in the additional unit has been connected to the shoot 142 in the additional unit. In addition, The additional unit 109 is electrically wired in installed status in the main body 102.

The shutter boards 52 of said respective shutters 124, 139A, 139B, and 143 in closed status receive drugs discharged from the tablet cases 3, 4, 6 . . . upward than respective shutters 124, 139A, 139B, and 143 and dropped down through the inside of respective shoots and release to drop in the hopper 111.

Figure 17:
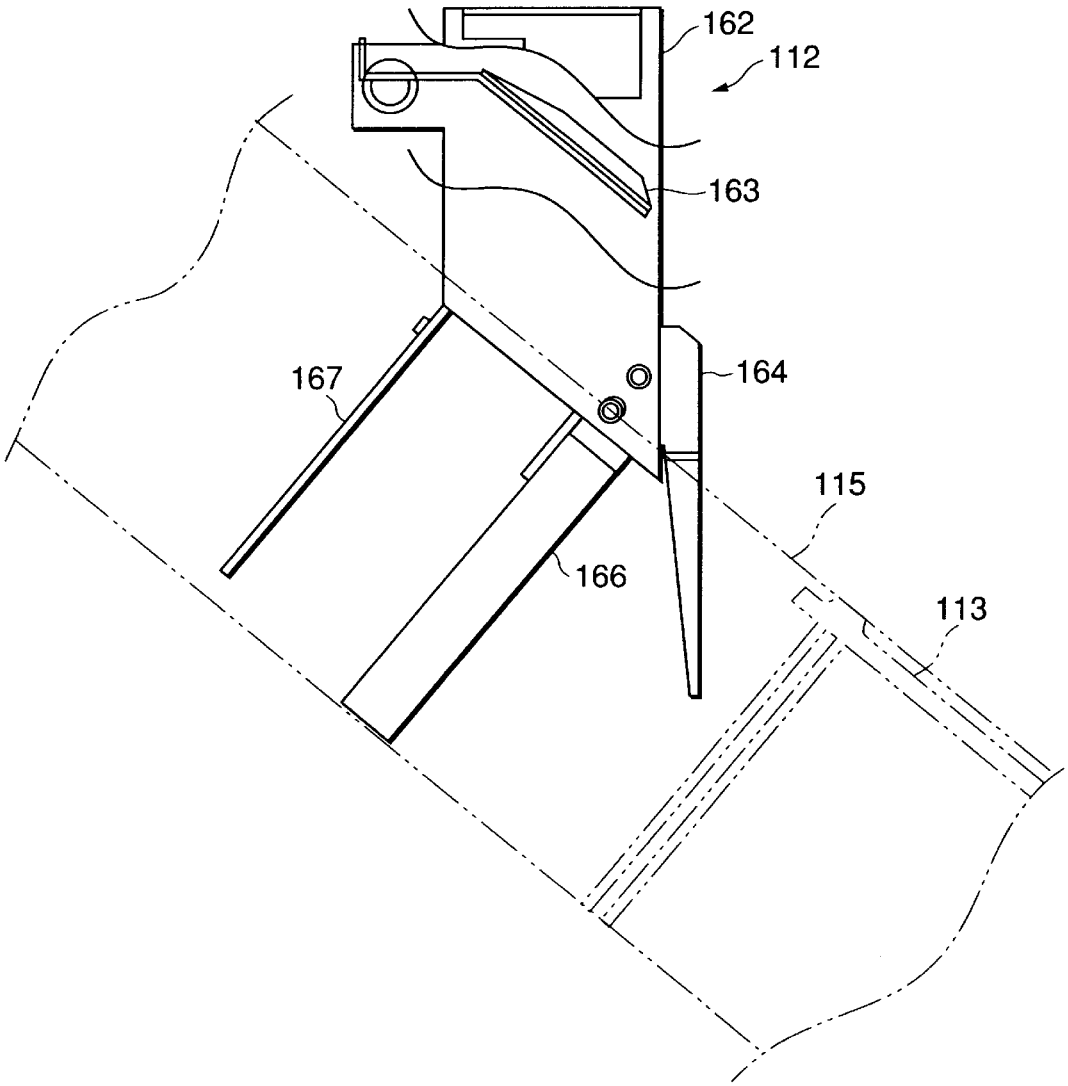
FIG. 17 is a partially cutaway side view of the shutter of the bottom end of the hopper of the drug dispensing apparatus of FIG. 13.

Said shutter 112 as shown in FIG. 17 comprises rectangular, cylindrical main body 162, a shutter board 163 of which one side has been supported by the main body 162 to allow free rotation in order to open and close the inside of the main body 162, a spring, not illustrated, energizing this shutter board 163 to close always, a solenoid, not illustrated, making said shutter board 163 a rotative motion, and inserting pieces 164, 166, and 167 installed in the lower end of the main body 162 to open by putting on a wrapping paper 115 folded to make a near V-shape from upward position.

Said electrified solenoid opens the shutter board 163 by clockwise rotation against an energized force of the spring as shown in FIG. 17. On the other hand, the non-electrified solenoid closes the passage in the main body 162 by lifting up the shutter board 163 with the spring. A drug dropped in the hopper 111 is received on the shutter board 163 under the condition of closed passage and dropped on the wrapping paper 115 by the shutter board 163 opened.

The following descriptions are for the positions of shutters 124, 139A, 139B, and 143 installed in said respective shoots 122, 137A, 137B, and 142. Respective shoots 122, 137A, 137B, and 142 have been installed in the position in which a time from dropping down of the drug discharged from the tablet cases 3 . . . of the top position in respective case containing units 108, 133A, 133B, 141 through respective shoots up to reaching respective shutters 124, 139A, 139B, and 143 and a time from dropping down of the drug from shutters 124, 139A, 139B, and 143 through the hopper 111 up to reaching shutter 112 become equal (in the apparatus of the example, 0.8 sec.). In the example, the position is determined as that corresponding to the position immediate over the lowermost step (for the door unit 102B, the additional drug feeder 146) in respective case containing units 108, 133A, 133B, 141.

Figure 18:
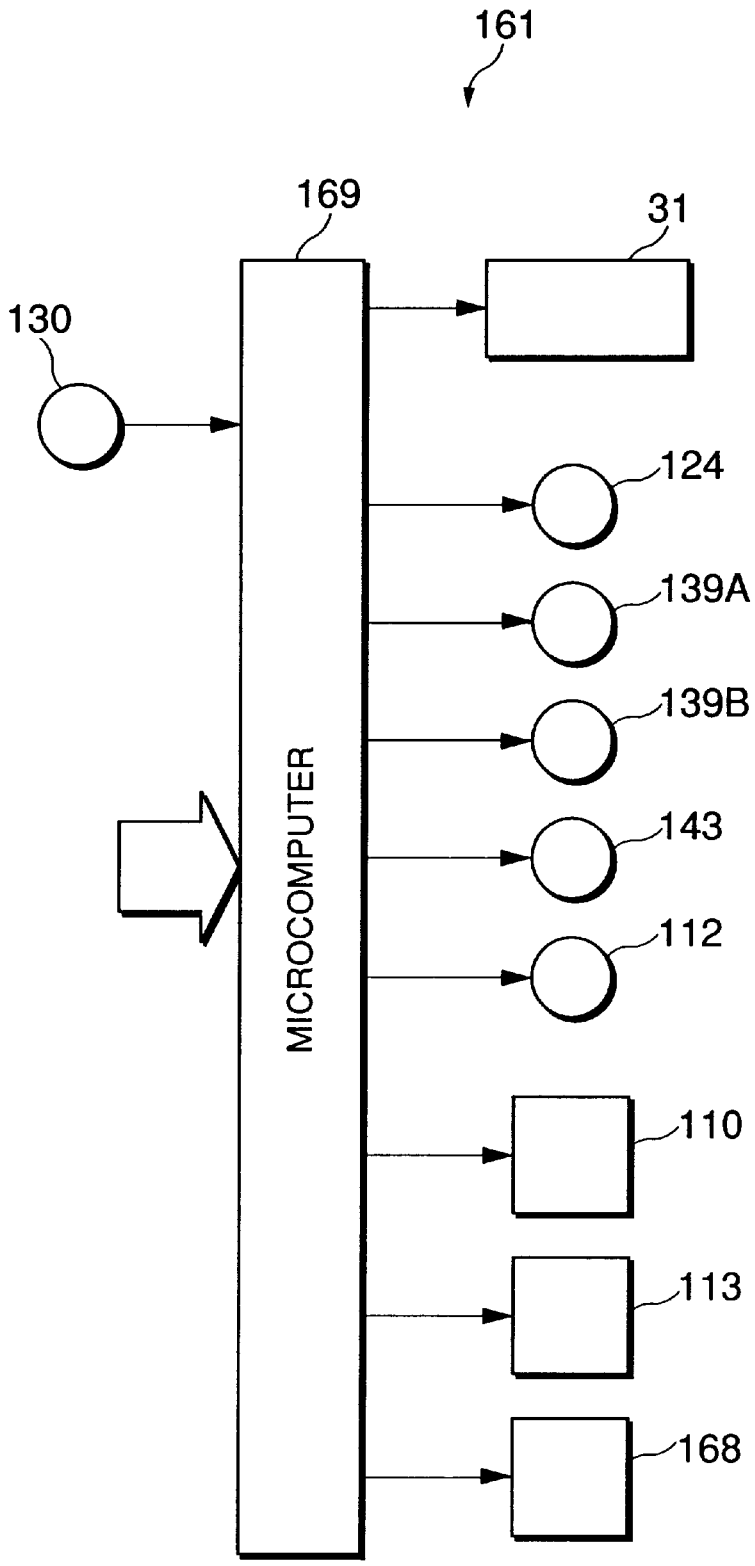
FIG. 18 is a functional block diagram of the control apparatus of the drug dispensing apparatus of FIG. 13.

In the functional block diagram of FIG. 18, the control apparatus 161 comprises multipurpose microcomputer 169. The input port of the microcomputer 169 receives an input signal of prescription data from an inputting apparatus (for example, personal computer) not illustrated and of drug detection from said drug detector 130. In addition, The output port of the microcomputer 169 has a connector to the discharging mechanisms 31 . . . of said tablet cases 3, 4, and 6, said respective shutters 124, 139A, 139B, 143, and 112, said printer 110, a sealer 113, and the feeder 168 of wrapping paper 115.

According to the constitution mentioned before, the use and action of the drug dispensing apparatus 101 of the present example is described with reference to FIG. 19–FIG. 22. It is assumed that said respective shutters 112, 124, 139A, 139B, and 143 have been closed in the condition of power source turned on. When the case containing unit 108 of the main body, case containing units 133A and 133B near doors of respective door units 102A and 102B, and the additional unit 109 are installed, said tablet cases 3, 4, or 6 is installed, in which a given drug has been respectively contained, in the case containing units 141 of the additional unit.

In this case, a drug of a large dosage quantity or a drug with a large size is contained in a tablet case 6 for a large volume, a drug of a medium dosage quantity or a drug with a medium size is contained in a tablet case 4 for a medium volume, a drug of a smallest dosage quantity or a drug with a smallest size is contained in a tablet case 3 for a small volume. The tablet cases 3, 4, or 6 are adjacently installed on the rack device 26 as mentioned before. In this arrangement, tablet cases with same volume are installed on the same the rack device 26.

The drug discharge action from respective tablet cases 3, 4, or 6 by the microcomputer 169 is first described with reference to FIG. 19–FIG. 21. Immediately after an operator inputs a formula data from said inputting apparatus (a personal computer) according to the prescription of a doctor, the microcomputer 169 pastes the content of the prescription data to the data table of FIG. 19.

Figure 19:
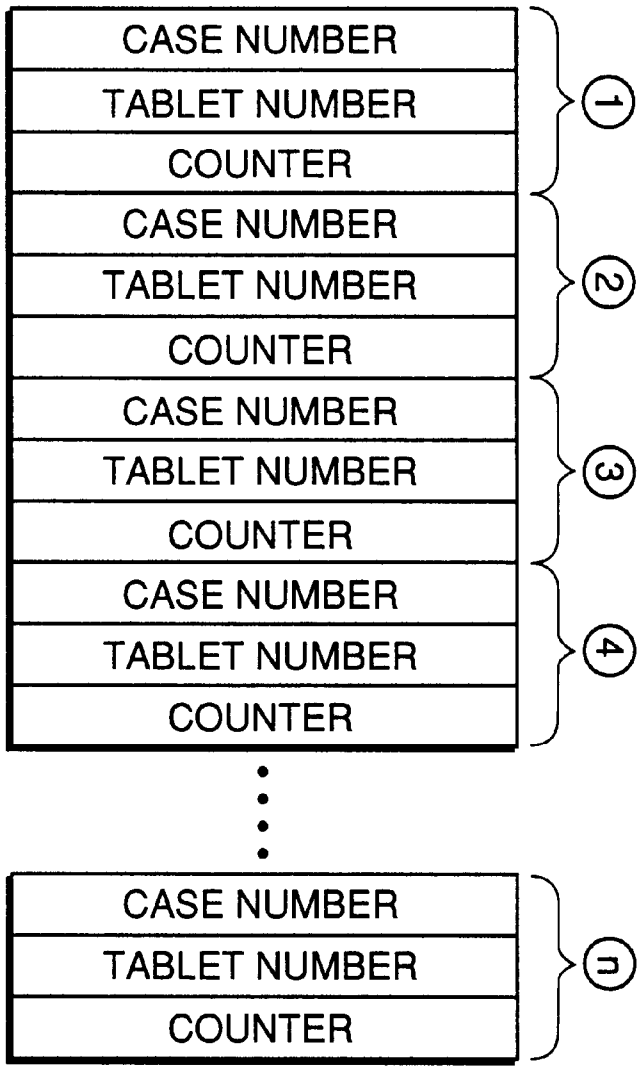
FIG. 19 is a figure showing the data table of the control apparatus of the drug dispensing apparatus of FIG. 13.

The numbers (1, 2, . . . ) used in the FIG. 19 are addresses assigned to respective tablet cases 3, 4, or 6. Each address comprises three data, i.e., a case number, a number of drug to discharge (tablet number), and a counter. The counter indicates the position of the rack device 26 in which the tablet cases has been installed, and the number is 1 for the top step and increases serially as 2, 3, . . . for lower steps of the rack. The content of prescription data is pasted as a tablet number corresponding to respective case number. Therefore, tablet number 0 is displayed for the tablet case in which drugs unnecessary of discharge are contained.

Figure 20:
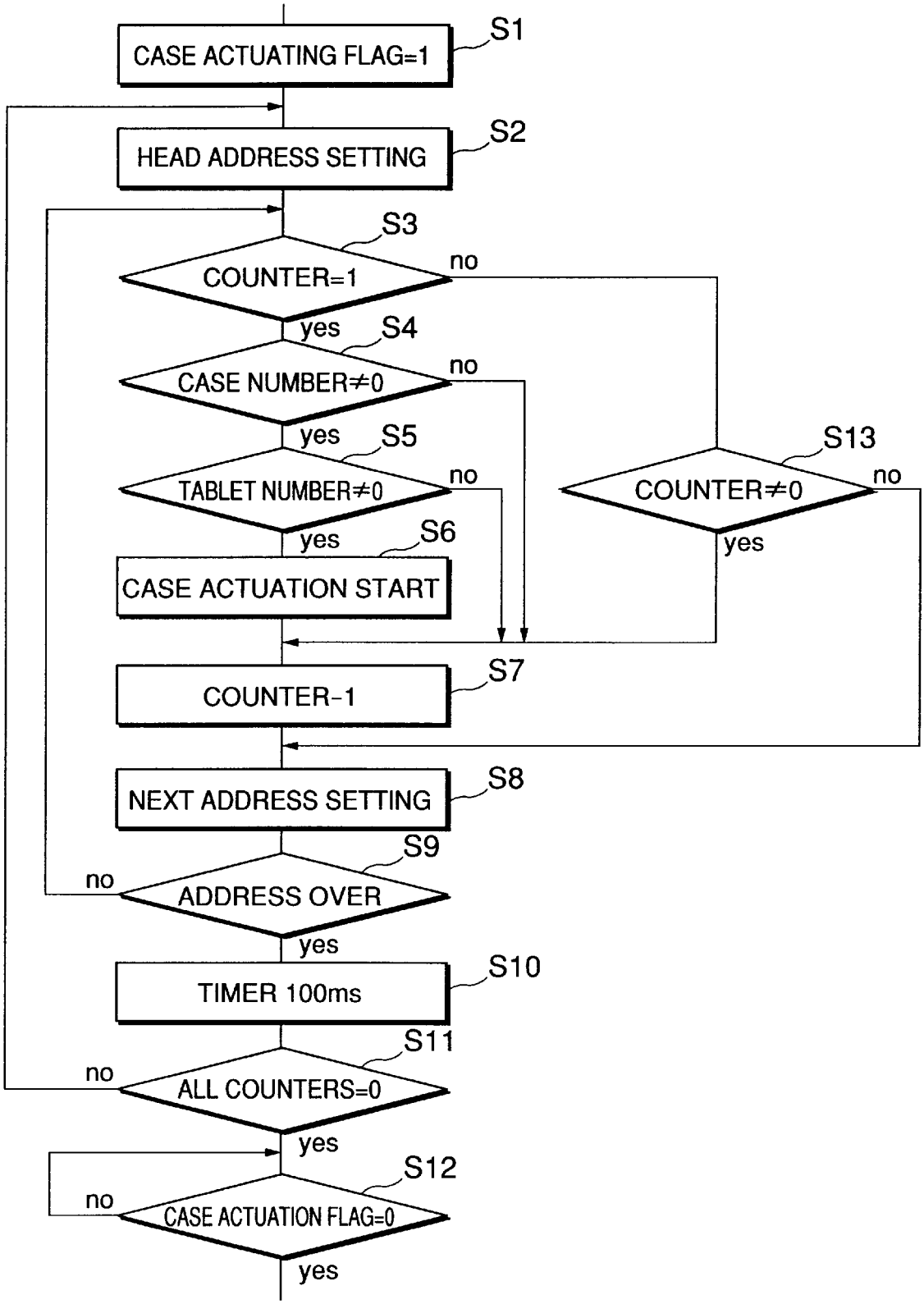
FIG. 20 is a flow chart showing the program of a microcomputer composing the control apparatus of the drug dispensing apparatus of FIG. 13.

The microcomputer 169 in discharge action for a drug sets ("1"): for a case actuating flag at the step S1 of the flow chart of FIG. 20, sets a head address (1) at step S2, decides 1 or not 1 displayed by the counter of the address at step S3; if 1, goes to the step S4 to decide 0 or not 0 of the case number; if not 0, goes to the step S5 to decide 0 or not 0 of tablet number; if not 0, goes to the step S6 to start actuating the discharging mechanism 31 of the tablet case 3 (4, or 6) of the address.

Subsequently, the counter of the address is set to −1 at step S7; the next address (2 in this case) is set at step S8 to go to step S9. At the step S9, decision is made about that all processes for addresses have been completed or not, and if not, the process goes to step S3. If the counter does not indicate 1 at the step S3, the process goes to step S13 and decides that the counter does indicate 0 or not 0; if not 0, goes to step S7 and if 0, goes to step S8.

When processing of all addresses are finished at the step S9, goes to step S10 to wait for 100 ms and goes to step S11 to decide that the counters of all the addresses indicates 0 or not 0; if not 0, goes back to step S2 and if 0, goes to step S12 to decide that the case actuating flag has been reset ("0") or not. If not 0, the step S12 is repeated to make the case actuating flag 0.

According to these controlling steps, scanning is carried out for all addresses starting at the rack device 26 of the top step, the discharging mechanism 31 of the tablet case 3 (4, or 6) of which tablet number is not 0 is started to actuate, this is executed up to the lowest step of the rack device 26, all tablet cases 3 (4, or 6) of which tablet number is not 0, i.e., required discharging a drug by the designation of a prescription data, is started to actuate the discharging mechanism 31.

Figure 21:
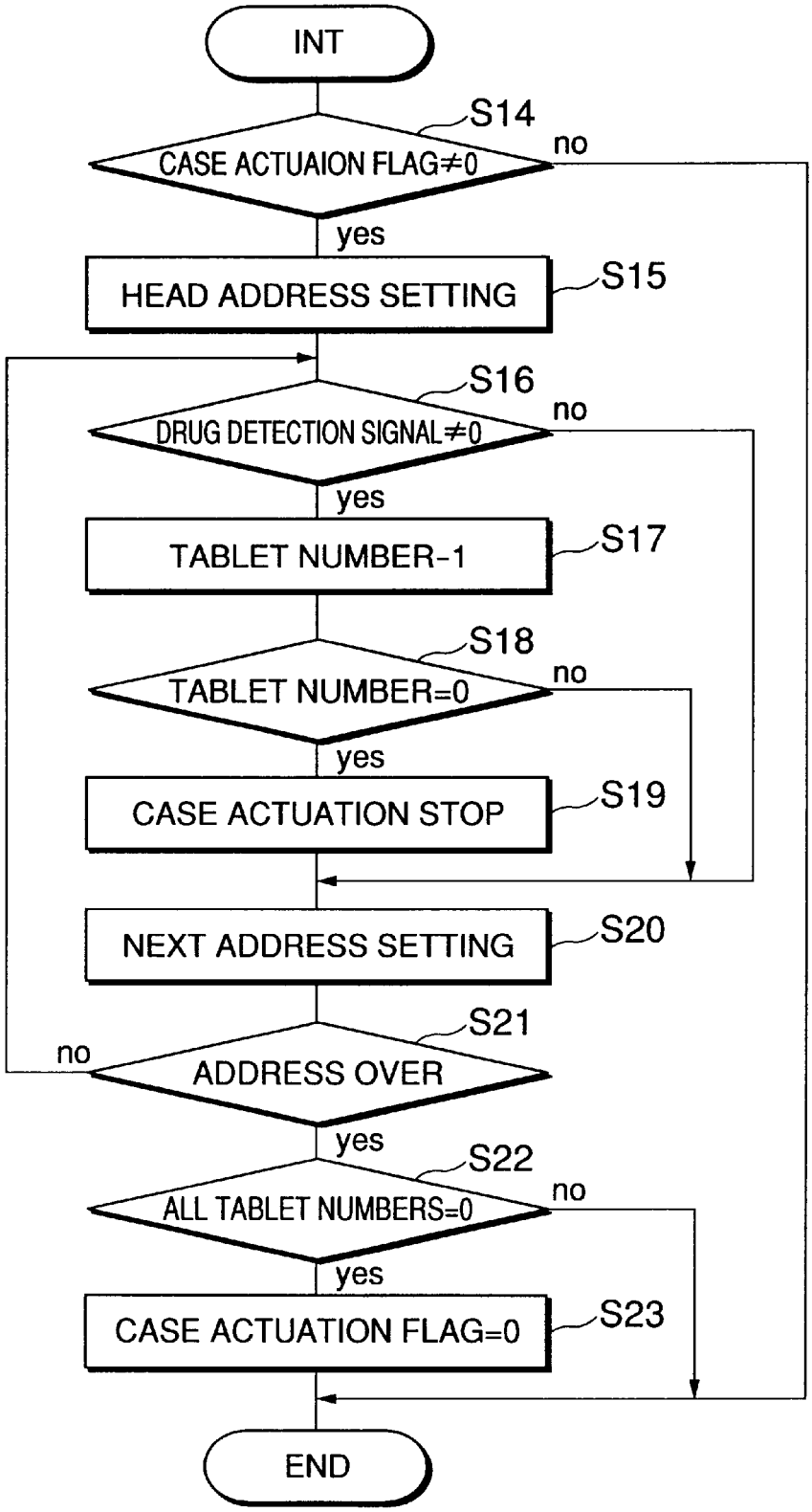
FIG. 21 is a flow chart showing another example of the program of a microcomputer composing the control apparatus of the drug dispensing apparatus of FIG. 13.

Next, the flow chart of FIG. 21 shows the action of counting the drug discharged and is subjected to interrupt process in the flow chart of FIG. 20 during setting of the case actuating flag. This means that the microcomputer 169 decides that the case actuating flag has been reset or not at step S14 and if reset, goes to step S15 to set the head address.

Subsequently, the microcomputer 169 decides that drug detection signal has come from the drug detector 130 corresponding to the tablet case 3 (or, 4, or 6) of the address at step S16 and if the signal has been inputted, make the tablet number −1 at step 17. Next, step S18 decides that the tablet number is 0 or not 0 and if not 0, goes to step S20 and if 0, stops actuating the discharging mechanism 31 of the tablet case at step S19 to go to the step S20. The step S20 set the next address. Step S21 decides that processing all addresses has been completed or not, and if not, go back to the step S16, and if completed, goes to the step S22 to decide that the tablet number of all addresses is 0 or not 0; if 0, goes to step S23 to reset the case actuating flag.

According these steps, the microcomputer 169 counts each individual discharged drug up to 0 tablet number for all the tablet case 3 (or, 4, or 6), and stops the discharging mechanism 31 at the step, where the drugs of the number based on the prescription data was discharged from all the tablet case of which discharging mechanism 31 has been started to actuate according to the flow chart of the FIG. 20. According to this, a given number of drugs is discharged.

Figure 22:
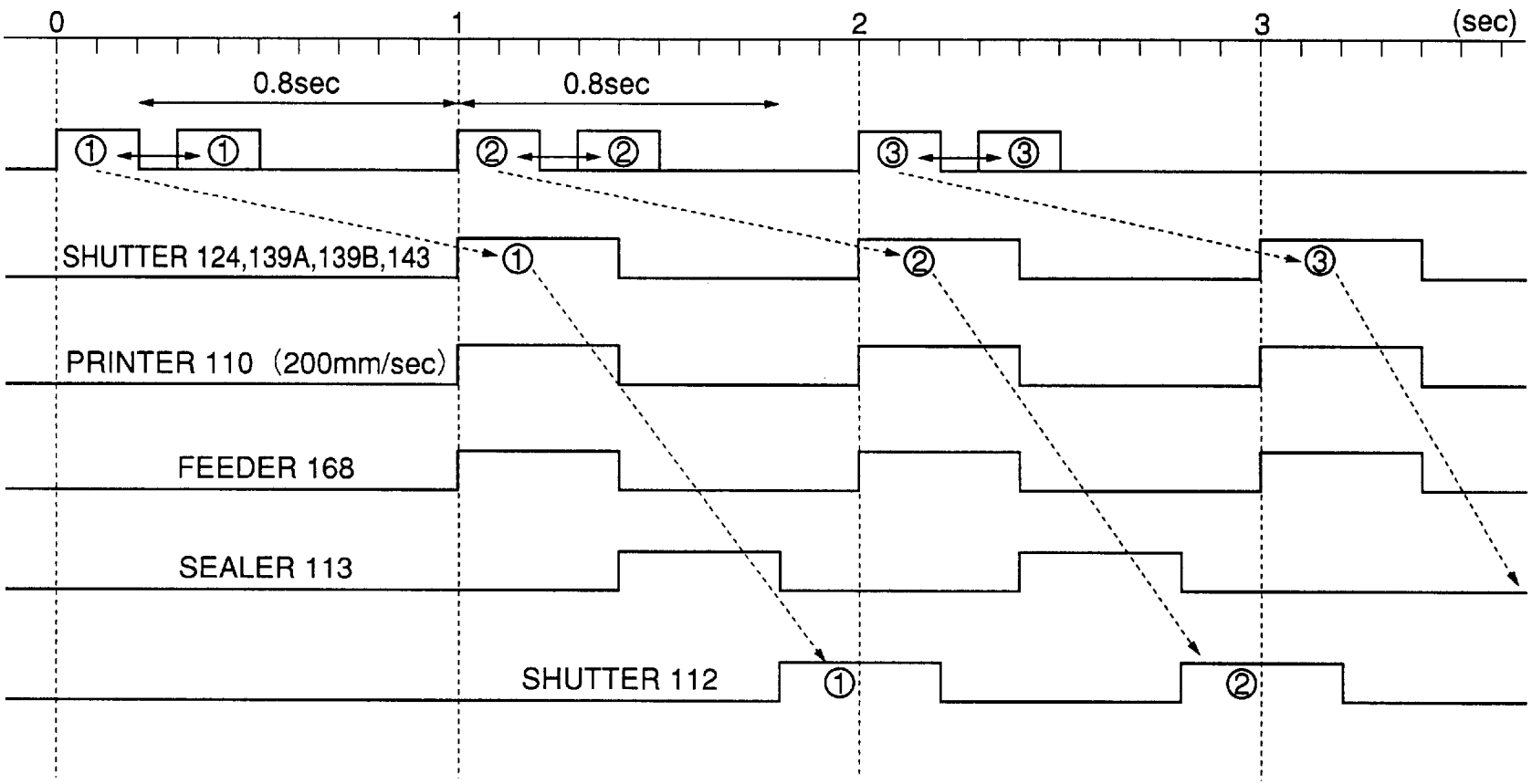
FIG. 22 is a timing chart explaining the action of the drug dispensing apparatus of FIG. 13.

Next, the followings are descriptions of action to discharge said drug controlled by the microcomputer 169 and the timing of action of said shutters 124 (139A, 139B, and 143), the shutter 112, the printer 110, the sealer 113, and the feeder 168 with reference to the timing chart of FIG. 22. The top step of the FIG. 22 shows discharging action of the tablet case 3 (or, 4, or 6) located in the upper part than respective shutters 124 (139A, 139B, and 143).

The microcomputer 169 in the start of action (time is 0) first operates said discharging action (the first discharging action (1)) of the tablet case 3 (or, 4, or 6) located in the upper position than that of the shutter 124 (139A, 139B, and 143) (0.2 sec. operation). The drug discharged is received by respective shutters 124 (139A, 139B, and 143) as stated before. In this case, a tablet case 3 located in more upper position (for example, the tablet case located in the top step) starts the discharging action earlier than (in the example, 1.3 sec. earlier in the maximum length) a tablet case beneath the case.

Dropping time from the tablet case located in the top step has been set 0.8 sec. as stated before, and all drugs including the drug from the lower tablet cases are received by shutters 0.8 sec. after the completion of the discharging action of the tablet case located in the top step.

Next, the shutter 124 (139A, 139B, and 143) is opened, the drug is dropped in the hopper 111, and synchronously, the printer 110 and the feeder 168 are operated for 0.4 sec., 0.8 sec. after the completion of the discharging action of the tablet case 3 located in the top step. The drug dropped are, as stated before, all received by the shutter 112, 0.8 sec. after the start of opening the shutter 124 (139A, 139B, and 143).

On the other hand, the microcomputer 169 starts the second discharging action (2) from the tablet case 3 of the top step, when the shutter 124 (139A, 139B, and 143) is opened. Also, the second discharging action (2) is started 0.1 sec. before completion of closing of the shutter 124 (139A, 139B, and 143) for tablet cases in the lower step than the position. This means that the second discharging action is operated during the drug discharged by the first discharging action is dropping on the shutter 112. The drug discharged by the second discharging action is dropped on the shutter 124 (139A, 139B, and 143) closed again to receive.

For the tablet case 3 of the top step, a considerable time is required until reaching the shutter 124 (139A, 139B, and 143) and therefore, even if discharging action is started at the same time as start of opening of the shutter, the shutter 124 (139A, 139B, and 143) has been closed at the moment of reaching. Further, for tablet cases 6 located in the position lower than that of respective shutters 124 (139A, 139B, and 143), discharging action is synchronously started with the second discharging action to drop directly on the shutter 112.

On the other hand, the microcomputer 169 operates the sealer 113 for 0.3 sec. to seal the wrapping paper 115 after the feeder 168 acted (that is, 0.8 sec. after starting of opening action of the shutter 124 (139A, 139B, and 143)), opens the shutter 112 after the completion of action of the sealer 113 in order to drop the first discharged drug (containing those discharged from the tablet cases located in the position lower than that of the shutter 124) on the wrapping paper 115. Subsequently, these steps are repeated.

According to these steps, the action interval of the shutter 112 becomes 1.0 sec. and wrapping performance becomes 60 packages/min. in this example.

Figure 23:
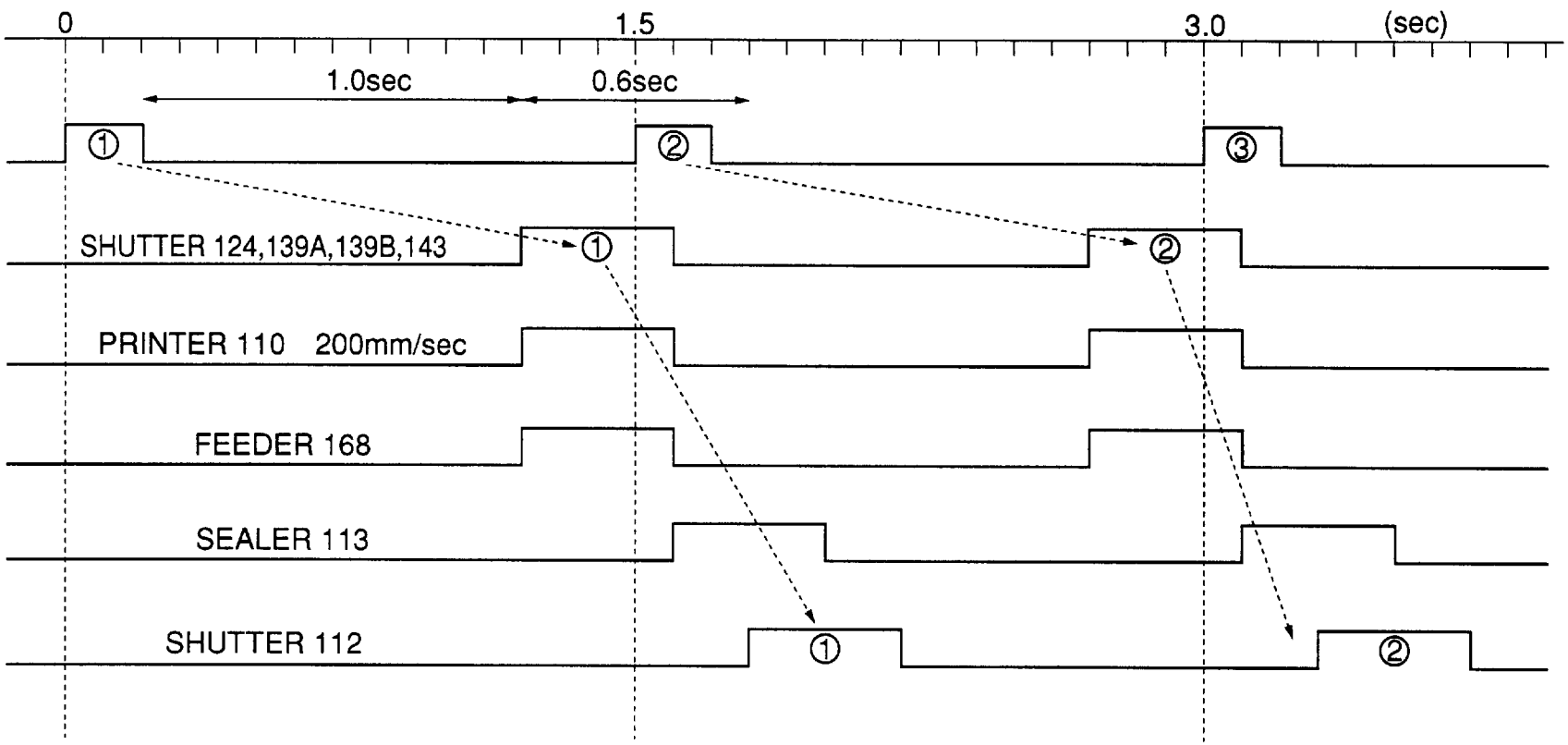
FIG. 23 is a timing chart explaining the action in comparison with the action of the drug dispensing apparatus of FIG. 13, when a shutter is installed in the bottom of the shoot.

For reference, when respective shutters 124, 139A, 139B, and 143 are installed in the lowermost steps of respective shoots 122, 137A, 137B, and 142, the time needed for dropping of the drug from the tablet cases located on the highest step on the shutter is 1 sec. in the example. Therefore, even if the time needed for dropping of the drug from shutters 124, 137A, 137B, and 142 to the shutter 112 is shorten to 0.6 sec., the waiting time for closing shutters 124, 137A, 137B, and 142 is prolonged. Therefore, as shown in FIG. 23, the action interval of the shutter 112 becomes 1.5 sec. as its result. And wrapping performance is limited to 40 packages/min. in this example.

However, according to the example, the time needed for reaching from the drug discharged from the tablet case 3 (4 and 6) located on the highest step to shutters 124, 137A, 137B, and 142 is equalized to the time for reaching the drug from the shutters 124, 137A, 137B, and 142 to the shutter 112, and when the drug is discharged from tablet cases located in the position higher than shutters 124, 137A, 137B, and 142, the drug is first received by shutters 124, 137A, 137B, and 142, and second, shutters 124, 137A, 137B, and 142 are opened prior to discharge of the drug from the tablet cases in order to receive the drug, that have been received by shutters 124, 137A, 137B, and 142, by the shutter 112 and the drug discharged from said tablet cases is received by shutters 124, 137A, 137B, and 142 closed again. These steps are repeatedly operated to make possible simultaneous operation of dropping and moving of the drug between the period from the tablet case to shutters 124, 137A, 137B, and 142 and the period from the shutters 124, 137A, 137B, and 142 to the shutter 112. Particularly, the drug is more fast discharged from tablet cases located in higher position requiring more times for dropping on shutters 124, 137A, 137B, and 142 in comparison with the tablet cases lower than them. Therefore, moving time of the drug can be markedly shortened in total. Consequently, drug-dispensing action becomes markedly fast and prominent improvement of operation efficiency can be achieved.

Figure 13:
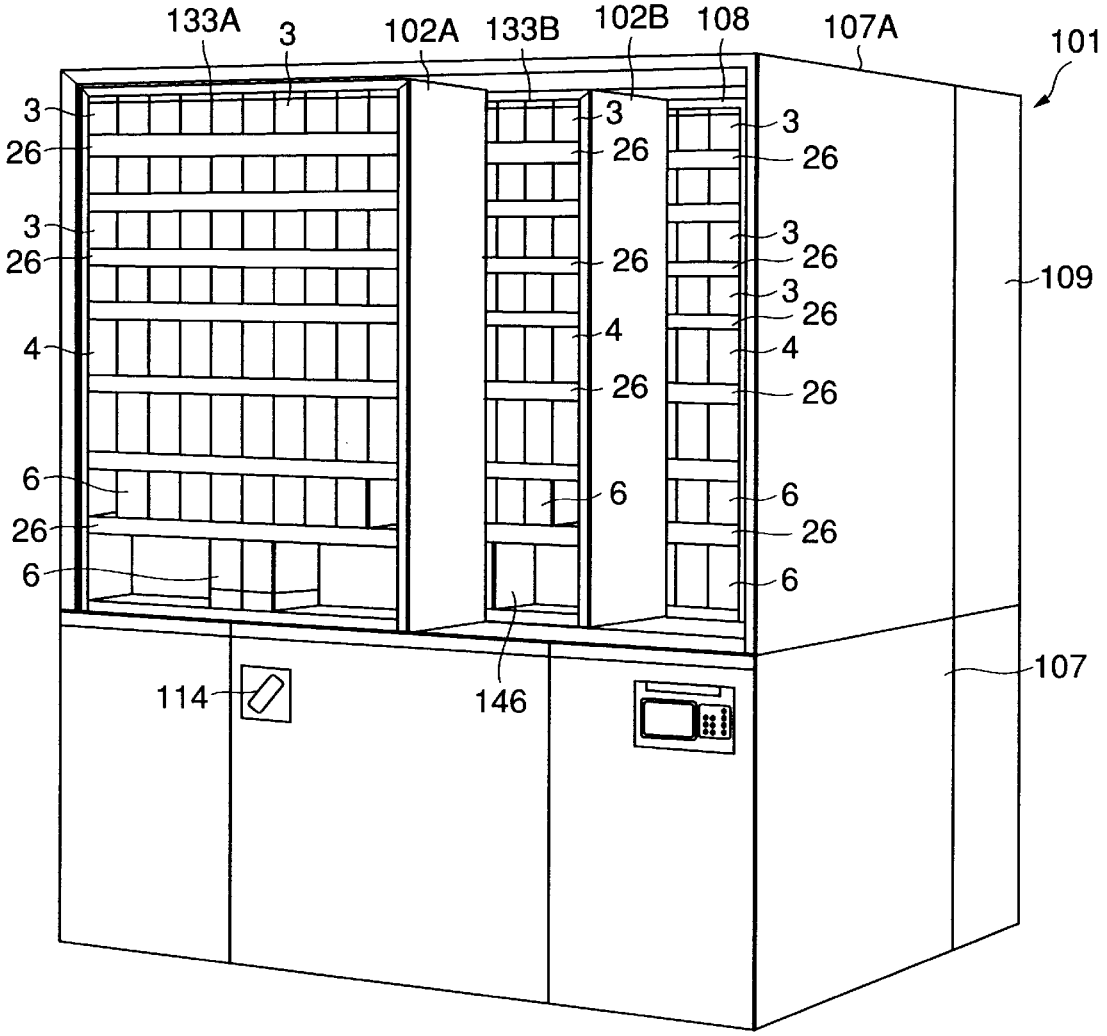
FIG. 13 is a perspective side view of the drug dispensing apparatus of other example of the present invention.

According to such drug dispensing action, when a drug is, for example, supplied to the tablet case installed in the right-hand side position by that the drug contained in tablet cases in the case containing unit 108 of the main body becomes insufficient, as shown in FIG. 13, the door unit 102B is moved to left-hand direction to open the left side part of the case containing unit 108 of the main body. After this step, drug-dispensing work to the tablet cases is performed. Even in this status, the opening 171B of the bottom end of the shoot 137B near the door of the door unit 102B is connected to the hopper 111 and the drug can be supplied from tablet cases in the case containing unit 133B near the door of the door unit 102B.

As described before in detail, the drug dispensing apparatus of the present example has the main body of which top has a case containing unit attached to the main body, a plurality of tablet cases installed in the inside of the case containing unit attached to the main body and containing respective drugs, a shoot in the main body, attached to the case containing unit attached to the main body, in which the drug discharged from respective tablet cases drops, a hopper installed in the main body corresponding to the bottom of a shoot in the main body, a plurality of door units closing the front openings of the case containing units attached to the main body in openable condition, a case containing unit near the door installed in respective door units, a plurality of tablet cases installed in the inside of the case containing unit near the door and respectively receive drugs, and a shoot near the door, installed in respective door units, in which the drug discharged from respective tablet cases inside the case containing unit near the door drops. Thus, a volume for containing drugs can be considerably increased in comparison with the installation space of whole apparatus.

In particular, respective door units are located in the front of the case containing unit attached to the main body and attached transversely and movably and opens and closes the case containing unit attached to the main body and in addition, said door side shoots of respective door units are connected to the hopper in any position. Thus, the drug can be discharged from the tablet cases installed in case containing unit near the door inside the door unit during supply of the drug to the case containing unit by moving the door unit and opening the front opening of the case containing unit attached to the main body, and improved use and fast dispensing action can be accomplished.

In addition to the structure mentioned before, a connecting unit with the hopper is formed in the moving range of the opening of the end of said shoot near the door. Besides, a means for closing the connecting unit located in other part than that having the opening of the end of the shoot near the door is installed. Thus, a defect of dropping of an exogenous matter and other drugs from the connecting unit between the shoot near the door and the hopper to inside the hopper can be prevented.

In addition to this advantage, an additional unit connected attachably and detachably to the back of the main body is installed. The additional units are attached to the case containing unit in the additional unit and the inside of the case containing unit for the additional unit, and have a plurality of tablet cases containing drugs respectively and a shoot, installed in the additional unit, in which the drug discharged from respective tablet cases inside the case containing unit in the additional unit drops, and the shoot in the additional unit under a connected condition to the back of the main body is connected to the hopper of the main body. Thus, when an additional unit is installed according to increased works, a large scale performance can be very easily accomplished.

Further, in addition to said respective inventions, respective openable shutters are installed in the shoot attached to the main body, the shoot attached to the door, and the bottom end of the hopper, or in the shoot attached to the main body, the shoot near the door, the shoot attached to the additional unit, and the bottom end of the hopper. Thus, simultaneous operation of drug discharge from many installed tablet cases and fast supply of drugs can be achieved by holding drugs, that are discharged from tablet cases in respective case containing units to respective shoots corresponding thereto, to discharge by respective shutters controlling timing.

What is claimed is:

1. A drug dispensing apparatus which comprises:

a main body having a main case housing section at its top;

a plurality of main tablet cases for storing the drugs, said main tablet cases being attached from a front opening of the main case housing section of the main body;

a main chute of the main body which is attached to the back of the main case housing section of the main body which is attached to the back of the main case housing section of the main body and through which drop the drugs discharged from the respective main tablet cases;

a hopper installed in the main body so as to be directed to the bottom of the main chute of the main body;

a door unit capable of openably closing the front opening of the main case housing section of the main body;

a door case housing section of the door unit provided on said door unit;

a plurality of door tablet cases being attached to said door case housing section of the door unit and which receive the drugs respectively;

a door chute of the door unit which is attached to the door unit and through which drop the drugs discharged from the respective door tablet cases in the door case housing section of the door unit; and said door chute of the door unit being directed to the top of the hopper in such a way that the door case housing section of the door unit is closed by the door unit.

2. The drug dispensing apparatus according to claim 1 which is equipped with an additional unit detachably connected to the back of the main body;

said additional unit being provided with an additional case housing section, a plurality of additional tablet cases for storing the drugs respectively, said additional tablet cases being attached to this additional case housing section of the additional unit; and an additional chute of the additional unit which is attached to a front side and through which drop the drugs discharged from the respective additional tablet cases in the additional case housing section of the additional unit; said additional chute of the additional unit being connected to the hopper of the main body in such a way as to be connected to the back of said main body.

3. The drug dispensing apparatus according to claim 1 or 2, wherein openable shutters are attached to one of (a) the lower ends of the main chute of the main body, the door chute of the door unit and the hopper, and (b) the lower ends of the main chute of the main body, the door chute of the door unit and the additional chute of the additional unit and the hopper, respectively.

4. The drug dispensing apparatus according to claim 1 or 2 which is equipped with a rack device which is hung in each case housing section and in which a plurality of tablet cases are arranged side by side; and rack holding sections, for detachably holding the rack device, which are formed in each case housing section;

said tablet cases having a plurality of large and small sizes; the plurality of rack holding sections being formed so as to extend over the top and bottom of each case housing section.

5. The drug dispensing apparatus according to claim 3, which is equipped with a rack device which is hung in each case housing section and in which a plurality of tablet cases are arranged side by side; and rack holding sections, for detachably holding the rack device, which are formed in each are housing section;

said tablet cases having a plurality of large and small sizes; the plurality of rack holding sections being formed so as to extend over the top and bottom of each case housing section.

6. A drug dispensing apparatus which comprises:

a main body having a main case housing section at its top;

a plurality of main tablet cases for storing drugs, said main tablet cases being attached in the main case housing of the main body;

a chute of the main body which is attached in the main case housing section of the main body and through which drop the drugs discharged from the respective main tablet cases;

a hopper installed in the main body so as to be directed to the bottom of this chute of the main body; a plurality of door units capable of openably closing the front opening of the main case housing section of the main body;

a door case housing section of the door unit provided on each door unit;

a plurality of door tablet cases which are attached to this case housing section of the door unit and which receive the drugs respectively; and a door chute of the door unit which is attached to each door unit and through which drop the drugs discharged from the respective tablet cases in the case housing section of the door unit;

each of said door units being attached movably in a transverse direction on the front side of the main case housing section of the main body so that the main case housing section of the main body may be opened and closed;

the door chute of the door unit of each door unit being connected to the hopper irrespective of any position of the main case housing section of the main body.

7. The drug dispensing apparatus according to claim 6, wherein a connecting portion with the hopper is formed over a moving range of a lower end opening of the shoot of the door unit, and a means for closing the connection portion, except portions where the lower end opening is present.

8. The drug dispensing apparatus according to claim 6 or 7 which is equipped with an additional detachably connected to the back of the main body;

said additional unit being provided with an additional case housing section of the additional unit, a plurality of additional tablet cases for storing the drugs respectively, said additional tablet cases being attached to this additional case housing section of the additional unit; and a chute of the additional unit which is attached to a front side and through which drop the drugs discharged from the respective additional tablet cases in the additional case housing section of the additional unit;

said additional chute of the additional unit being connected to the hopper of the main body in such a condition as to be connected to the back of said main body.

9. The drug dispensing apparatus according to claim 5 or 7 wherein openable shutters are attached to at least one of (a) the lower ends of the main chute of the main body, the door chute of the door unit and the hopper, and (b) the lower ends of the main chute of the main body, the door chute of the door unit and the additional chute of the additional unit and the hopper, respectively.

10. The drug dispensing apparatus according to claim 6, or 7 which is equipped with a rack device which is hung in each case housing section and in which a plurality of tablet cases are arranged side by side; and rack holding sections, for detachably holding the rack device, which are formed in each case housing section;

said tablet cases having a plurality of large and small sizes; the plurality of rack holding sections being formed extending over top and bottom of each case housing section.

11. The drug dispensing apparatus according to claim 8, wherein openable shutters are attached to at least one of (a) the lower ends of the main chute of the main body, the door chute of the door unit and the hopper, and (b) the lower ends of the main chute of the main body, the door chute of the door unit and the additional chute of the additional unit and the hopper, respectively.

12. The drug dispensing apparatus according to claim 8, which is equipped with a rack device which is hung in each case housing section and in which a plurality of tablet cases are arranged side by side; and rack holding sections, for detachably holding the rack device, which are formed in each case housing section;

said tablet cases having a plurality of large and small sizes; the plurality of rack holding sections being formed extending over top and bottom of each case housing section.

13. The drug dispensing apparatus according to claim 9 which is equipped with a rack device which is hung in each case housing section and in which a plurality of tablet cases are arranged side by side; and rack holding sections, for detachably holding the rack device, which are formed in each case housing section;

said tablet cases having a plurality of large and small sizes; the plurality of rack holding sections being formed extending over top and bottom of each case housing section.

* * * * *